US008186959B2

(12) United States Patent
Iwai

(10) Patent No.: US 8,186,959 B2
(45) Date of Patent: May 29, 2012

(54) TURBINE MOVING BLADE ASSEMBLY AND TURBINE HAVING THE SAME

(75) Inventor: Masahiko Iwai, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 583 days.

(21) Appl. No.: 12/467,578

(22) Filed: May 18, 2009

(65) Prior Publication Data

US 2010/0068061 A1 Mar. 18, 2010

(30) Foreign Application Priority Data

Sep. 12, 2008 (JP) ..... 2008-235556

(51) Int. Cl.
*F01D 5/22* (2006.01)

(52) U.S. Cl. ..... 416/191; 416/195

(58) Field of Classification Search ..... 416/195, 416/191; 415/228

See application file for complete search history.

(56) References Cited

U.S. PATENT DOCUMENTS 5,829,955 A * 11/1998 Saito et al. ..... 416/191

FOREIGN PATENT DOCUMENTS

| | | |
|---|---|---|
| JP | 2-016303 A | 1/1990 |
| JP | 4-005402 A | 1/1992 |
| JP | 3178327 B2 | 4/2001 |

OTHER PUBLICATIONS

T. Ikeda et al., "The Development of a Titanium 40-in. Last-Stage Blade for 3600 rpm Large Steam Turbines", Toshiba Corporation New Power System Division, Yokohama, Japan, Latest Advances in Steam Turbine Design, Blading, Repairs, Condition Assessment, and Condenser Interaction, Book No. H00515, 1989, pp. 69-76.

* cited by examiner

*Primary Examiner* — Richard Edgar
(74) *Attorney, Agent, or Firm* — Foley & Lardner LLP

(57) ABSTRACT

A shroud of adjacent turbine moving blades has the primary contact face portion, which has opposing flat faces forming an acute angle from a turbine rotating direction and has the secondary contact face portion which has opposing flat faces forming an obtuse angle from the turbine rotating direction. In a process of increasing the rotor speed of a turbine, the secondary contact face portion shifts from a contacting state to a separated state, and thereafter, the primary contact face portion shifts from the separated state to the contacting state. According to such arrangement, vibration in a turbine higher speed range can be suppressed in addition to the suppression of the contact reaction force between coupling members of adjacent turbine moving blade from increasing too high, thereby improving the reliability of the turbine moving blades.

7 Claims, 23 Drawing Sheets

DURING INCREASING ROTOR SPEED OF TURBINE

AT RATED ROTOR SPEED

PRIMARY CONTACT FACE PORTION

SECONDARY CONTACT FACE PORTION

BLADE ASSEMBLED STATE (TURBINE STOP STATE)

ROTATING AT NEAR CONTACT START
ROTOR SPEED OF PRIMARY CONTACT FACE

BLADE ASSEMBLED STATE
(TURBINE STOP STATE)

REVOLUTION NUMBER
AT CONTACT START TIME

AT ZERO ROTOR SPEED

AT LOWER ROTOR SPEED

AT RATED ROTOR SPEED

AT ZERO ROTOR SPEED

AT LOWER ROTOR SPEED

AT RATED ROTOR SPEED

AT RATED ROTOR SPEED

AT LOWER ROTOR SPEED

AT ZERO ROTOR SPEED

ROTATING AT NEAR CONTACT START ROTOR SPEED

TURBINE MOVING BLADE ASSEMBLY AND TURBINE HAVING THE SAME

BACKGROUND OF THE INVENTION

1. Field of the Invention

The present invention relates to a turbine moving blade assembly, which is particularly used for a portion from an intermediate pressure section to a low pressure section in a steam turbine and the like, and to a turbine having such turbine moving blade assembly, and more particularly, relates to a turbine moving blade assembly for suppressing vibration of respective turbine moving blades and a turbine having the turbine moving blade assembly.

The turbine blade assembly is composed of a plurality of turbine moving blades mounted, in a circumferential direction, on a rotor of a turbine and including twisted blades each having a relatively long blade length and being twisted from root potions toward tip portion.

2. Description of the Related Art

Recently, it is strongly required for many power generation plants to be operated at a high loads with a high availability regardless of their types. Thus, a turbine as main equipment of a power generation plant must withstand the operation at part load as well as rated load, and the repeated start and stop with the significant change in operation. Accordingly, sufficient reliability for operation is further required than ever to all the elements or components constituting the turbine.

A turbine moving blade, in particular, a final stage turbine blade having a long length, which is subjected to a large centrifugal force, is typically exemplified as a most important component of the turbine components described above.

An important problem of the operation reliability of a turbine moving blade, in particular, a long blade, resides in how to suppress a resonant phenomenon under the condition that an excitation frequency the rotor speed coincides with one of the natural frequencies of the turbine moving blades.

In a case of the turbine moving blades, in particular, a long blade, composed of twisted airfoils, a twist/untwist (hereinafter, also called untwist) force acts thereon increases. Various shapes of snubber blades enhance vibration suppression effect by changing a vibration mode by coupling the turbine moving blades with each other at the rated rotor speed of a turbine making use of the untwist force, and such snubber blades are widely used as shown in FIGS. 16 and 17.

As shown in FIG. 16, a plurality of turbine moving blades 1, 2, 3 . . . are arranged and assembled in a circumferential direction of a turbine rotor 4. These turbine moving blade 1, 2, 3 . . . are twisted blades, each having an airfoil portion 5 twisted from a root portion 5*b* toward a tip portion 5*a* in its sectional shape.

Shrouds 6 are formed to the tip portion 5*a* of the airfoil portion 5 (i.e., blade tip portion 1*a*, 2*a* . . . of FIG. 17) in the turbine moving blades 1, 2 . . . so as to be integral therewith, respectively. As shown in FIG. 17, the respective shrouds 6 of the turbine moving blades 1, 2, . . . have leading side snubbers 1*b*, 2*b* . . . projecting from the leading edge suction side of the blade tip portion 1*a*, 2*a* . . . and trailing side snubbers 1*c*, 2*c*, . . . projecting from the trailing edge pressure side of the blade tip portion 1*a*, 2*a* . . . .

A turbine moving blade coupling, which can couple the turbine moving blades 1, 2 . . . with each other, is composed of a plurality of shrouds 6 having the leading side snubbers 1*b*, 2*b* . . . and the trailing side snubbers 1*c*, 2*c* . . . , respectively.

Further, it is to be noted that a reason why the shrouds 6 are not formed to cover entire airfoil shape at tip resides in that a centrifugal force acting on the leading side snubbers 1*b*, 2*b* . . . and the trailing side snubbers 1*c*, 2*c* . . . is reduced by minimizing the volume of the leading side snubbers 1*b*, 2*b* . . . and the trailing side snubbers 1*c*, 2*c*.

When the turbine moving blades 1, 2 . . . are assembled, that is, in a turbine stop state of a portion of FIG. 17A, a gap (assembly gap) D is set between, for example, the trailing side snubber 1*c* of the turbine moving blade 1 and the leading side snubber 2*b* of the turbine moving blade 2.

When the centrifugal force acting on the turbine moving blades 1, 2 . . . increases as the rotor speed of the turbine increases, since an untwist force acts on the airfoil portions 5 of the turbine moving blades 1, 2 . . . , a gap D (gap caused in assembling) is gradually narrowed, and a contact face 1*f* of the trailing side snubber 1*c* starts to come into contact with a contact face 2*f* of the leading side snubber 2*b* at a specific rotor speed Rc for start of contact, thus giving a state as shown in FIG. 17B.

When the contact face if once comes into contact with the contact face 2*f*, even if the rotor speed of the turbine further increases, the relative position of the trailing side snubber 1*c* and the leading side snubber 2*b* does not change, and a reaction force between the contact faces 1*f* and 2*f* increases.

When the gap D between the leading side snubber 2*b* and the trailing side snubber 1*c* is too large, the contact face 1*f* does not come into contact with the contact face 2*f* even if a predetermined untwist force acts thereon, and consequently, a vibration suppression effect is not attained at the rated rotor speed of the turbine. On the contrary, when the gap D is too small, the contact reaction force is made too large, an excessive stress occurs at the root portion in which the leading side snubber 1*b* or the trailing side snubber 1*c* projects from the blade tip portion 1*a* of the turbine moving blade 1.

Accordingly, the contact start rotor speed Rc, at which the leading side snubber 2*b* starts to come contact with the trailing side snubber 1*c*, must be determined in consideration of the magnitude of the contact reaction force acting on the contact faces 1*f* and 2*f* at the rated speed or an over speed of the turbine, in particular, in consideration of the magnitude of the stress in the root portions in which the leading side snubbers 1*b*, 2*b* . . . and the trailing side snubber 1*c*, 2*c* . . . project from blade tip portion 1*a*, 2*a* . . . in view of strength.

When the contact start rotor speed Rc is set to a specific value, the untwist of the turbine moving blades 1, 2 . . . after, for example, the trailing side snubber 1*c* came into contact with the leading side snubber 2*b*, holds a constant value at the rotor speeds higher than the contact start rotor speed Rc as shown in a curve 101 (shown by a solid line) with respect to a curve 100 (shown by a broken line) of a single blade as shown in FIG. 18, and the contact reaction force increases as the rotor speed increases at the rotor speeds higher than the contact start rotor speed Rc as shown in a curve 102.

FIG. 19 shows an example of a Campbell diagram of the turbine moving blades 1, 2 . . . as described above and shows the relationship between the change in a natural frequency of the turbine moving blades 1, 2 . . . (single blade mode, continuously-coupled blade mode) and the rotor speed of the turbine, with the reference of multiple frequencies of rotor speed.

When, for example, a letter T shows a natural frequency of a vibration mode in a tangential direction (turbine rotating direction) that is a fundamental mode of the single turbine moving blade, the natural frequency of the vibration mode T resonates at $t_1$ with the double-speed component, at $t_2$ with the triple-speed component, and at $t_3$ with the quadruple-speed component of the turbine, and there is a possibility that the vibration stress increases at these resonant points. Further, when a letter A shows a natural frequency of a vibration mode in an axial direction (turbine axial direction) that is also a fundamental mode of the single turbine moving blade, the natural frequency resonates at $a_1$ with the quadruple-speed component, and at $a_2$ with the triple-speed component of the turbine.

Whether or not an operation at these resonant points $t_1$, $t_2$, $t_3$, $a_1$, $a_2$ is dangerous depends on the magnitude of the excitation force and the vibration response characteristics of the turbine moving blades 1, 2 . . . at these resonant points. In general, an excitation force is high for lower values of multiples and for higher rotor speed, and the vibration response is higher for the lower modes of vibration.

Further, in the turbine moving blades 1, 2 . . . , when the rotor speed of the turbine exceeds the contact start speed Rc of the leading side snubbers 1*b*, 2*b* . . . and the trailing side snubbers 1*c*, 2*c* . . . , the vibration mode of the turbine moving blades 1, 2 . . . shift from the single blade mode to the continuously-coupled mode. Since the vibration of the continuously-coupled mode is an axial vibration GA mode as a blade group, the vibration level thereof becomes low at the resonant points, besides the natural frequency of the axial vibration GA mode is sufficiently separated from the multiples of rated rotor Ro. Accordingly, the vibration of the continuously-coupled turbine moving blades 1, 2 . . . is suppressed.

Japanese Unexamined Patent Application Publication No. H02-16303 (Patent Publication 1) discloses a turbine moving blade coupling for shifting, when the vibration level is high at any of the resonant points $a_1$, $a_2$, $t_1$, $t_2$, $t_3$ in the single blade mode shown in FIG. 19, the single blade mode in lower speed range to the continuously-coupled mode to suppress the increasing in vibration. This structure is shown in FIGS. 20 to 22, which mainly employs a technology for shifting to the continuous coupling of the adjacent turbine moving blades 1, 2 . . . by the leading side snubbers 1*b*, 2*b*, . . . and the trailing side snubbers 1*c*, 2*c* . . . making use of the untwist force in a higher speed range. However, the technology realizes the continuous coupling in the lower speed range as well as in the higher speed range by changing the contact faces of snubbers capable of coming into contact even in the lower speed range.

When it is intended to realize the contact from the lower speed range to the higher speed range by one contact face, the contact start rotor speed Rc is set to the lower speed range as apparent from the contact reaction force characteristic curve 102 of FIG. 18. However, in this case, since the contact reaction force in the higher speed range becomes too large, the strength of the root portions, in which the leading side snubbers 1*b*, 2*b* and the trailing side snubbers 1*c*, 2*c* . . . are projected from the blade tip portion 1*a*, 1*b* . . . of the turbine moving blades 1, 2 . . . , is deteriorated.

To cope with the above problem, the Patent Publication 1 employs a system for providing steps on the contact faces 1*f*, 1*g*, 2*f*, 2*g* . . . of the trailing side snubbers 1*c*, 2*c* . . . , for causing, for example, the contact face 1*g* of the trailing side snubber 1*c* to come into contact with the contact face 2*f* of the leading side snubber 2*b* in the turbine lower speed range, and for causing, for example, the contact face 1*f* of the trailing side snubber 1*c* to come into contact with the contact face 2*f* of the leading side snubber 2*b* in the turbine higher speed range as shown in FIG. 20.

FIG. 21 shows a system for replacing the positions of the contact faces having the steps with a case shown in FIG. 20, causing, for example, the contact face 1*f* of the trailing side snubber 1*c* to come into contact with the contact face 2*g* of the leading side snubber 2*b* in the turbine lower speed range, and causing, for example, the contact face 1*f* of the trailing side snubber 1*c* to come into contact with the contact face 2*f* of the leading side snubber 2*b* in the higher speed range.

Further, FIG. 22 shows a system for providing a projection 1*m* to one of the contact face (for example, the contact face 1*f* of the trailing side snubber 1*c*) in place of the step so that the projection 1*m* comes into contact with the other contact face (for example, the contact face 2*f* of the leading side snubber 2*b*) in the lower speed range.

In the arrangement mentioned above, when the gap between the contact faces is appropriately selected, the contact reaction force on each contact faces (projection) is made as shown in FIG. 23 when the contact reaction force characteristic curve 102 of FIG. 18 is used as a reference. That is, the contact starts at a rotor speed of r1 according to a contact reaction force characteristic curve 103 and separated at a rotor speed of r2.

When the rotor speed further increases, the contacting starts again at the rotor speed of Rc according to a contact reaction force characteristic curve 104 and keeps the contacting state over the rated rotor speed of Ro with the contact reaction force increasing.

As described above, the blades take continuously-coupled mode in the rotor speed range in which any of the faces contact.

Further, it is to be noted that a part of the single blade mode in the lower speed range shown in the Campbell diagram of FIG. 19 is replaced by the continuously-coupled mode as shown in FIG. 24 for the turbine moving blades 1, 2 . . . shown in FIGS. 20 to 22.

It may be found from the above explanation that basic requirement for improving the reliability of the turbine moving blades 1, 2 . . . employing the snubbers is approximately satisfied by the conventional (background) technology.

That is, first, the leading side snubbers 1*b*, 2*b*, . . . and the trailing side snubbers 1*c*, 2*c* . . . are formed such that the amount of projection thereof projecting from the blade tip portion 1*a*, 2*a* . . . is further reduced as the blades are longer to improve safety by suppressing a centrifugal force.

Second, when the gap (assembly gap) between the leading side snubbers 1*b*, 2*b* . . . and the trailing side snubbers 1*c*, 2*c* . . . is reduced at the time when the turbine is stopped, the leading side snubbers 1*b*, 2*b* . . . can be caused to come into contact with the trailing side snubbers 1*c*, 2*c* . . . in the lower speed range. However, since the contact reaction force becomes too large when the rated rotor speed of the turbine is reached, consequently, the stress becomes too large in the root portions in which the snubbers project from the blade tip portion 1*a*, 2*a* . . . , an assembly gap of an appropriate value is set.

Third, in order to obtain the continuously-coupled instead of the single blade mode in the lower speed range, an additional contact face (projection), which makes contact even in the lower speed range, is provided to a regular contact face in the higher speed range.

Actually, however, there are scatters as to the assembled state of the turbine moving blades, the untwist force of the airfoil portions 5 of the turbine moving blades 1, 2 . . . , and the contact between the leading side snubbers 1*b*, 2*b* . . . and the trailing side snubbers 1*c*, 2*c* . . . , and the like. As a result, there are scatters in the rotor speed at which contact starts, a contact area, and the like. Accordingly, in order to improve the reliability of the turbine moving blades 1, 2 . . . , it is necessary to consider the reduction of the adverse affect due to the scatter mentioned above as well as the basic requirements also mentioned above.

Here, a consideration will be made on a case, in which the above-mentioned scatter occurs to the gap D between the leading side snubbers 1*b*, 2*b* . . . and the trailing side snubbers 1*c*, 2*c* . . . of the turbine moving blades 1, 2 . . . shown in FIG. 17. In this case, first, it is assumed as shown in FIG. 25 that the gap D is different because the turbine moving blade 2 is assembled by being slightly inclined in a turbine rotating direction, i.e., to the turbine moving blade 1 side.

In this case, since a gap $D_2$ between the trailing side snubber 2*c* of the turbine moving blade 2 and the leading side snubber 3*b* of the turbine moving blade 3 is larger than a gap $D_1$ between the trailing side snubbers 1*c* of the turbine moving blade 1 and the leading side snubber 2*b* of the turbine moving blade 2, i.e., $D_2>D_0>D_1$, wherein $D_0$ is a designed assembly gap.

When the rotor speed of the turbine is increased in the above-mentioned state, the trailing side snubber 1*c* and the leading side snubber 2*b*, by which the gap $D_1$ is formed, begin, first, to come into contact with each other (the gap $D_1=0$), and the trailing side snubber 2*c* and the leading side snubber 3*b*, by which the gap $D_2$ is formed, have a gap $D_2'(<D_2)$ as shown in FIG. 26. As the rotor speed increases, the contact reaction force on the contact face between the trailing side snubber 1*c* on the gap $D_1$ side and the front snubber 2*b* is increased until the trailing side snubber 2*c* starts to come into contact with the leading side snubber 3*b*.

In this state, a contact reaction force Fc acts on the contact face 2*f* of the leading side snubber 3*b* of the turbine moving blade 2 from the contact face 1*f* of the trailing side snubber 1*c* of the turbine moving blade 1 in a direction vertical to the contact face 2*f*.

An axial component Fa of the turbine rotor (rotor) in the contact reaction force Fc acts in a direction in which the turbine moving blade 2 is inclined towards outlet side in the axial direction of the rotor thereof.

Furthermore, when the turbine moving blade 2 is assembled in a counter-rotating direction of the turbine, i.e., assembled by being slightly inclined on the turbine moving blade 3 side contrary to the example shown in FIGS. 25 and 26, and the gap D is different as shown "$D_1>D_0>D_2$", the trailing side snubber 2*c* on the gap $D_2$ side first starts to come into contact with the leading side snubber 3*b*. In this case, the contact reaction force from the turbine moving blade 3 acts on the contact face 2*f* of the trailing side snubber 2*c* of the turbine moving blade 2 vertically to the contact face 2*f*.

An axial component of the rotor in the contact reaction force acts in a direction in which the turbine moving blade 2 is inclined towards the inlet side of the axial direction of the rotor.

That is, when there is scatter in the assembly gaps D between the leading side snubbers 1*b*, 2*b* . . . and the trailing side snubber 1*c*, 2*c*, . . . of the turbine moving blades 1, 2 . . . , the contact start rotor speed Rc in the respective turbine moving blades 1, 2 . . . is scattered. As a result, some of the turbine moving blades 1, 2 . . . in rotation are inclined towards the inlet side (front side in the turbine rotor axial direction) or towards the outlet side (rear side in turbine rotor axial direction).

As described above when the turbine moving blades 1, 2 . . . are restricted once, due to the friction force on the contact faces of the leading side snubbers 1*b*, 2*b* . . . and the trailing side snubbers 1*c*, 2*c* . . . it is very difficult to change the relative position therebetween, and thus, the restricted position therebetween is kept as it is until the turbine is operated at a rated speed. As a result, when the turbine moving blades 1, 2 . . . are outstandingly inclined towards the inlet side or to the outlet side with respect to the rotor, not only the performance of the blade row is adversely affected but also the turbine moving blades 1, 2 . . . suffer from erosion in different degree, and thus, there is a possibility that a turbine performance as well as the blade reliability is deteriorated.

SUMMARY OF THE INVENTION

The present invention was conceived in consideration of the circumstances encountered in the prior art mentioned above, and a primary object of the present invention is to provide a turbine moving blade assembly which can suppress vibration in the high and low rotor speed ranges as well as can prevent the contact reaction force between coupling in adjacent turbine moving blades from becoming too large to thereby improve the reliability of the turbine moving blades and also provide a turbine having the turbine moving blade assembly.

Another object of the present invention is to provide a turbine moving blade assembly which can prevent deterioration of a turbine performance and reliability by suppressing that turbine blades are inclined in an axial direction due to the dispersion of the gap between couplings in adjacent turbine moving blades and a turbine having the turbine moving blade assembly.

The above and other objects can be achieved according to the present invention by providing, in one aspect, a turbine moving blade assembly comprising:

a plurality of moving blades arranged in a circumferential direction of a rotor of a turbine;

an airfoil portion of each of moving blades twisted from a root portion to a tip portion of the blade thereof;

a shroud formed integrally with the tip portion of the moving blade; and a coupling member disposed to a front end portion of the moving blades including the tip portion of the moving blade and the shroud so as to combine the moving blades in a group, wherein the coupling member has: a primary contact face portion, which has flat contact faces forming an acute angle from a rotating direction of the turbine toward an outlet side in an axial direction of the rotor of the turbine and facing the tip portions of the turbine moving blades adjacent to each other in the circumferential direction; a secondary contact face portion which has flat contact faces forming an obtuse angle from the rotating direction of the turbine toward the outlet side in the axial direction of the rotor and facing the tip portions of the turbine moving blades adjacent to each other in the circumferential direction, the respective primary contact face portions of the turbine moving blades are in a separated state during assembly of the blades, the respective secondary contact face portions of the turbine moving blades are in a contacting state during assembly of the blades, and as a rotor speed increases, the respective second contact face portions of the turbine moving blades shift from a contacting state to a separated state, and thereafter, as the rotor speed further increases, the primary contact face portions shift from the separated state to the contacting state of the turbine moving blades adjacent to each other in the circumferential direction.

In the above aspect, the following preferred embodiments or examples may be provided.

It may be desired that the primary contact face portion is disposed on the outlet side in the axial direction of the rotor of the turbine with respect to the secondary contact face portion.

It may be desired that the primary contact face portion is disposed on the inlet side in the axial direction of the rotor with respect to the secondary contact face portion.

It may be desired that the shroud in each turbine moving blade has a leading side snubber projecting from a suction side of the airfoil tip portion and a trailing side snubber projecting from a pressure side thereof, the primary contact face portion is formed to a leading edge side of the leading side snubber and to a trailing edge side of the trailing side snubber, and the secondary contact face portion is disposed on the outlet side in the axial direction of the rotor in the primary contact face portion disposed to the leading side snubber and to the pressure side in the trailing edge side of the airfoil tip portion.

It may be also desired that the shroud in each of the turbine moving blades has a leading side snubber projecting from a suction side of the airfoil tip portion and a trailing side snubber projecting from a pressure side thereof, and an adjacent blade proximal face portion facing, with a gap, the tip portions of the turbine moving blades adjacent to each other in the circumferential direction, is disposed on the inlet side of the primary contact face portion in the axial direction of the rotor of the turbine.

It may be further desired that the rotor speed at a contacting start, in which the primary contact face portion shifts to the contacting state, is set to 60% to 75% of a rated rotor speed, and the rotor speed at a separating start, in which the secondary contact face portion shifts from the contacting state to the separated state, is set lower than the contacting start rotor speed of the primary contact face portion by 5% to 20% of the rated rotor speed.

In another aspect of the present invention, there is also provided a turbine comprising:

a casing;

a turbine rotor rotatably accommodated in the casing; and a turbine moving blade assembly, of the aspect mentioned above, provided for the turbine rotor.

According to the present invention, since the shift property of the secondary contact face portion from the contacting state to the separated state and the shift property of the primary contact face portion can be relatively optionally selected, a continuously-coupled mode and a single blade mode of the turbine moving blades can be optimally chosen in the wide rotor speed range. Accordingly, a vibration in a high speed range as well as a low speed range can be suppressed in addition to the prevention of the contact reaction force on coupling members in adjacent turbine moving blades from being made too high, thereby improving the reliability of the turbine moving blades.

The nature and further characteristic features of the present invention will be made clearer from the following descriptions made with reference to the accompanying drawings.

BRIEF DESCRIPTION OF THE DRAWINGS

In the accompanying drawings:

FIG. 12 includes FIGS. 12A, 12B, 12C and 12D, in which

FIG. 13 includes FIGS. 13A, 13B, 13C and 13D, in which

FIG. 17 shows a plurality of shrouds of FIG. 16 and includes FIGS. 17A and 17B, in which

FIG. 20 shows a plurality of shrouds having a second conventional structure of the turbine moving blade coupling, and includes FIGS. 20A, 20B and 20C, in which

FIG. 21 shows a plurality of shrouds having a third conventional structure of the turbine moving blade coupling, and includes FIGS. 21A, 21B and 21C, in which

FIG. 22 shows a plurality of shrouds having a fourth conventional structure of the turbine moving blade coupling, and includes FIGS. 22A, 22B and 22*c*, in which

DESCRIPTION OF THE PREFERRED EMBODIMENTS

Preferred embodiments of the present invention will be described hereunder with reference to the accompanying drawings, but the present invention is not limited to the embodiments. Further, it is to be noted that terms "upper", "lower", "right", "left" and like terms representing positions or arrangement of moving blades, etc. are used herein with reference to the illustrations of the accompanying drawings or in actually assembled state of moving blades of a turbine.

First Embodiment

FIGS. 1 to 9

Figure 1:
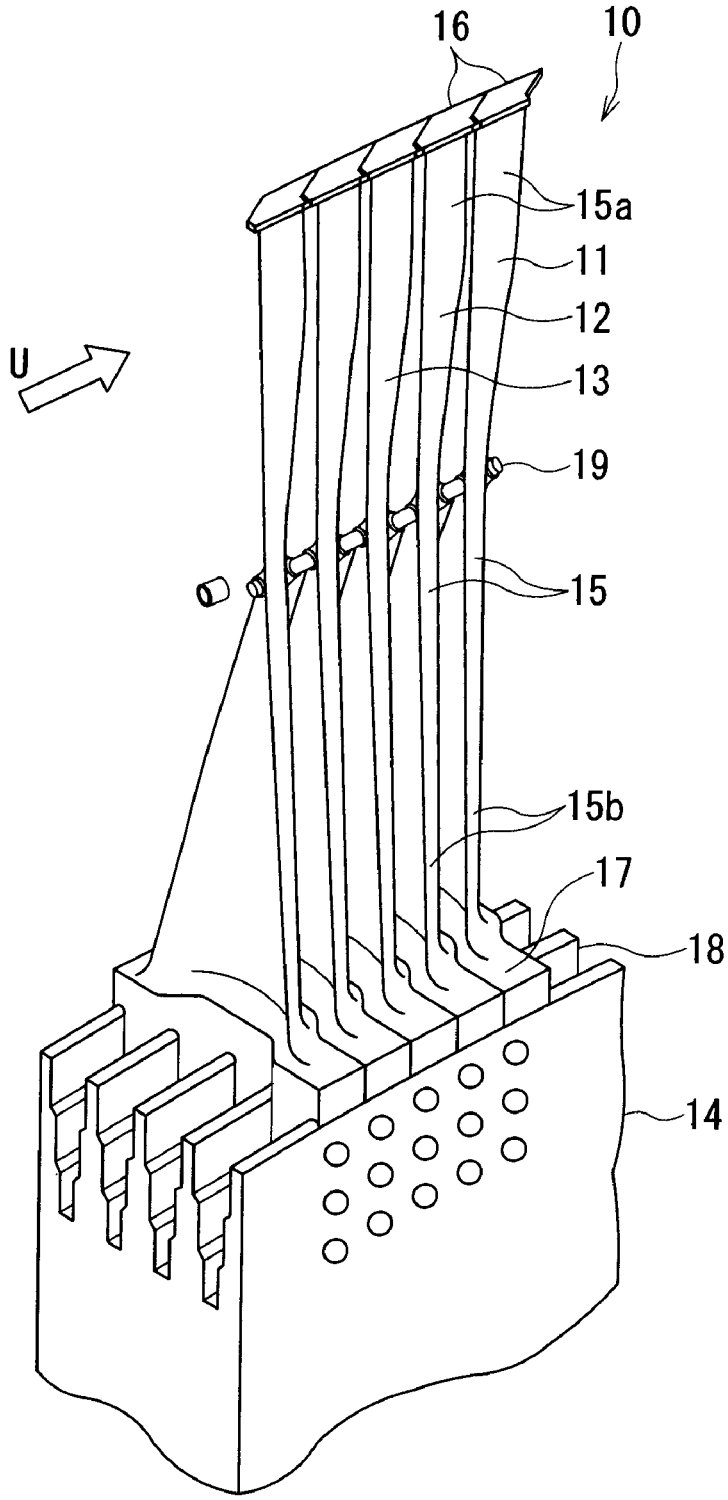
FIG. 1 is a perspective view, in an enlarged scale, showing a portion of a turbine moving blade assembly of a first embodiment according to the present invention so as to show an assembled state of respective turbine moving blades.

With reference to FIGS. 1 to 4, as shown in FIG. 1, a turbine moving blade assembly 10 according to the first embodiment is arranged such that a plurality of turbine moving blades 11, 12, 13 . . . having airfoil portions 15 and shrouds 16 are disposed in and assembled around the circumferential direction of a turbine rotor 14.

In this arrangement, respective built-in portions 17 of the turbine moving blades 11, 12, 13 . . . are embedded in grooves 18 formed to the turbine rotor 14 and fixed by means of pins, not shown, for example. Each of the turbine moving blades 11, 12, 13 . . . is a twisted blade having an airfoil shape of each airfoil portion 15 twisted from a root portion 15*b* toward a tip portion 15*a*. The turbine is arranged by rotatably accommodating the turbine moving blade assembly 10 in a casing, not shown, together with the turbine rotor 14.

Further, reference numeral 19 in FIG. 1 denotes a vibration suppression coupling in the central portions of the turbine moving blades 11, 12, 13 . . . with each other.

Figure 2:
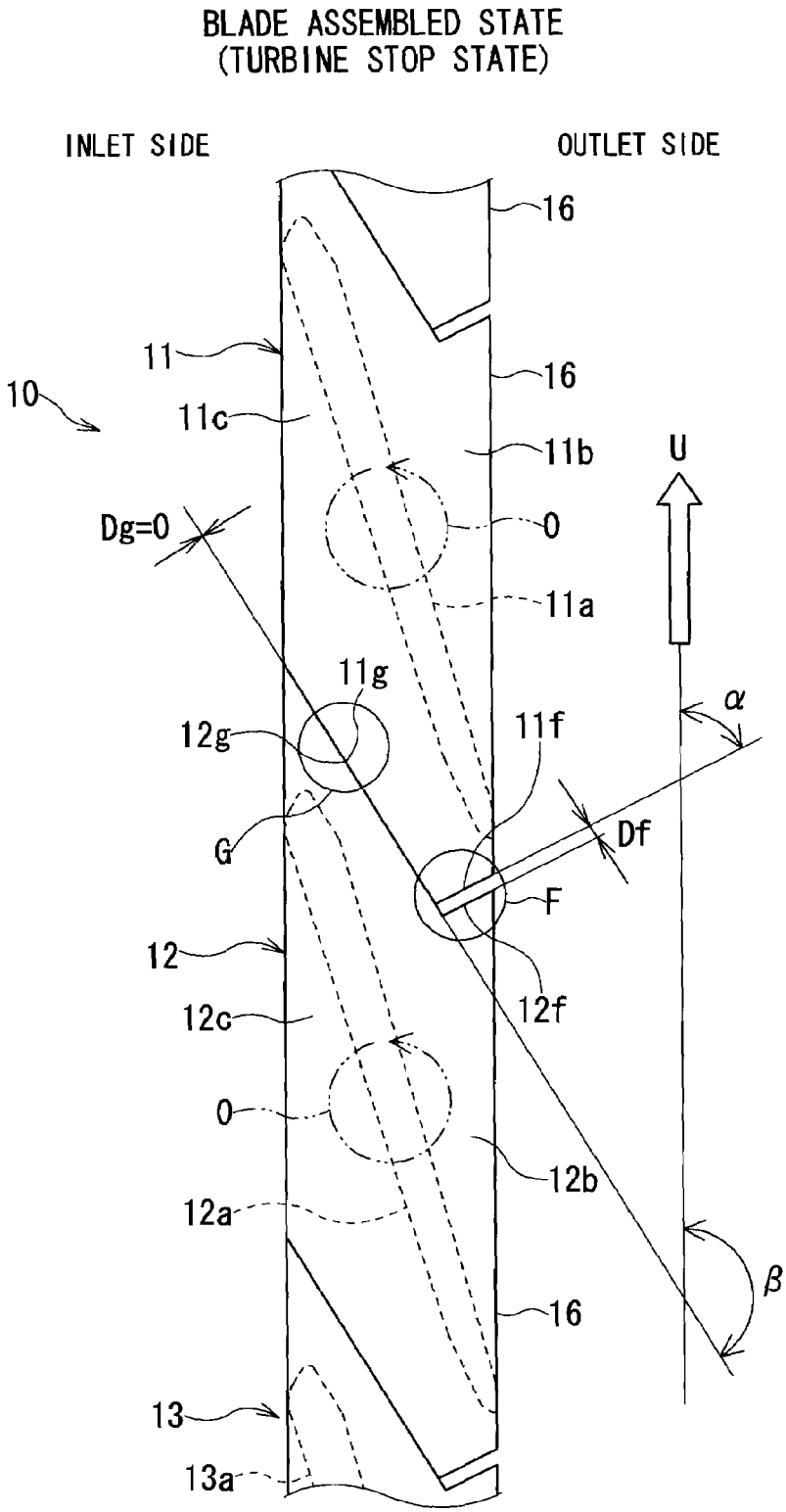
FIG. 2 is an illustration of a front elevational view showing a turbine (operation) stop state in a plurality of shrouds in the turbine moving blade assembly of FIG. 1 as viewed from the outside in a radial direction.

The respective shrouds 16 are integrally formed to tip portions 15*a* (i.e., airfoil tip portion 11*a*, 12*a* . . . of FIG. 2) of the airfoil portions 15 in the turbine moving blades 11, 12 . . . . As shown in FIG. 2, the respective shrouds 16 of the turbine moving blades 11, 12 . . . have leading side snubbers 11*b*, 12*b* . . . projecting from the suction sides of the airfoil tip portion 11*a*, 12*a* . . . and trailing side snubbers 11*c*, 12*c* . . . projecting from the pressure sides of the airfoil tip portion 11*a*, 12*a* . . . .

The plurality of shrouds 16 having the leading side snubbers 11*b*, 12*b* . . . and the trailing side snubbers 11*c*, 12*c* . . . act as couplings so that the turbine moving blades 11, 12 . . . can be coupled with each other by the shrouds 16 as one ring.

As shown in FIG. 2, the primary contact face portion F and a second contact face portion G are formed between the end faces (contact faces 12*f* and 12*g*) of the leading side snubber 12*b* in the shroud 16 of an arbitrary turbine blade, for example, the turbine moving blade 12 in the turbine blades 11, 12 . . . and the end faces (contact faces 11*f* and 11*g*) of the trailing side snubber 11*c* in the shroud 16 of, for example, the turbine moving blade 11 adjacent to the turbine moving blade 12.

That is, the primary contact face portion F is formed of confronting flat contact faces, for example, contact faces 11*f*, 12*f* . . . which create an acute angle α from a turbine rotating direction U (rotor) toward an outlet side in the axial direction of the turbine rotor 14 thereof.

Further, the secondary contact face portion G is formed of confronting flat contact faces, for example, contact faces 11*g*, 12*g* . . . which create an obtuse angle β from the rotating direction U (rotor) toward an outlet side in the axial direction of the turbine rotor 14 thereof.

The primary contact face portion F is disposed on the outlet side in the axial direction of the turbine rotor 14 to the secondary contact face portion G. Further, in FIG. 2, the axial direction of the rotor (turbine rotor) 14 is a direction orthogonal to the rotating direction U.

In the assembled state of the turbine blades 11, 12 . . . at which the turbine stops, a gap Df is formed between the contact faces 11*f* and 12*f* which form the primary contact face portion F so that both the contact faces 11*f*, 12*f* are separated from each other.

Further, the contact faces 11*g* and 12*g*, which constitute the secondary contact face portion G, are provided in a contacting state in the assembled state of the turbine moving blades 11, 12 . . . , and a gap Dg between the contact faces 11*g* and 12*g* is set to Dg=0. Further, the contact face 11*g* is pressed against the contact face 12*g* in the assembled state of the turbine moving blades 11, 12 . . . , and a contact reaction force is generated to both the contact faces 11*g* and 12*g*.

Figure 3:
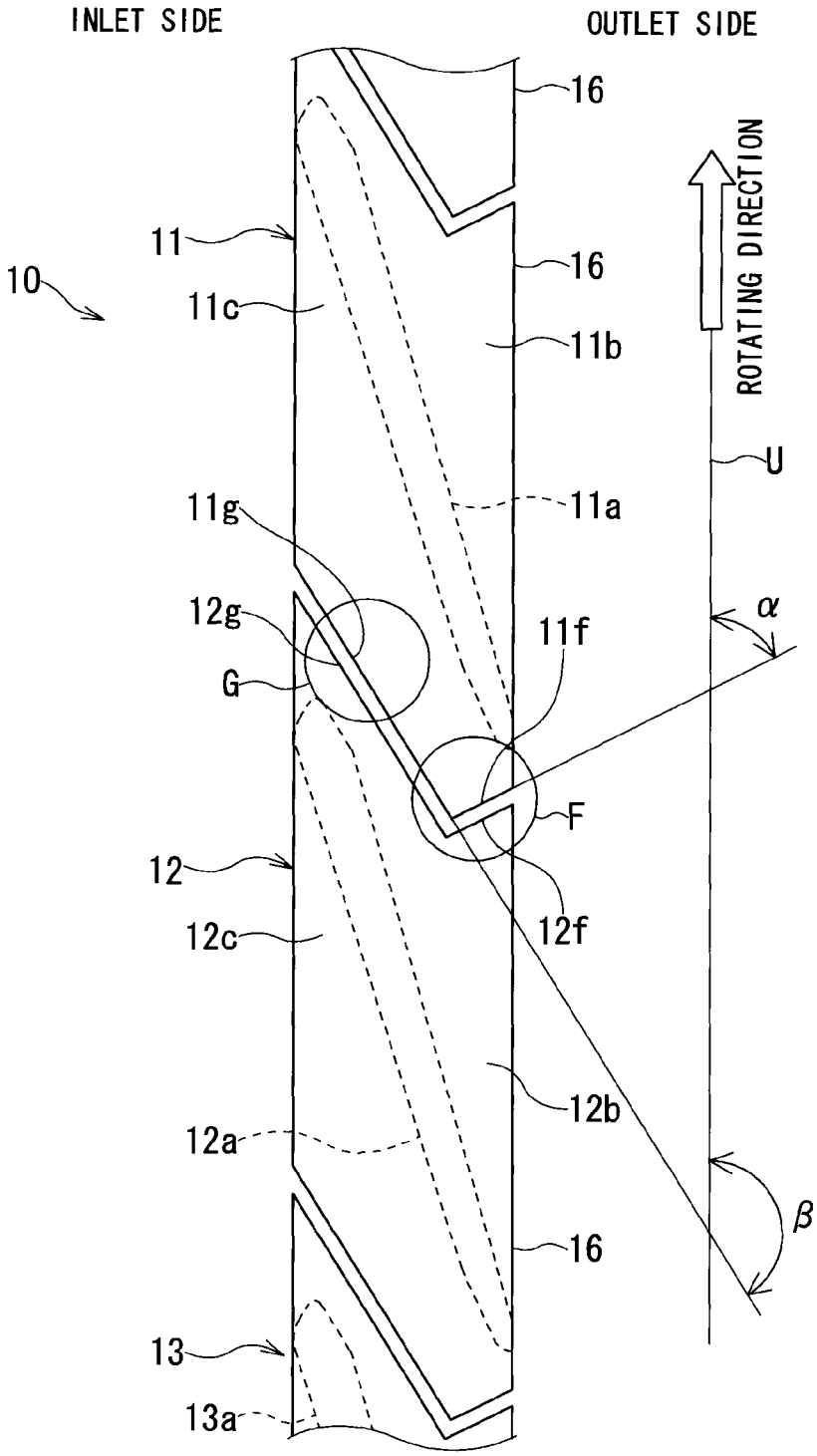
FIG. 3 is an illustration of a front elevational view showing a state of rotating while increasing the rotor speed of the turbine in the plurality of shrouds of the turbine moving blade assembly of FIG. 1 as viewed from the outside in the radial direction.
Figure 4:
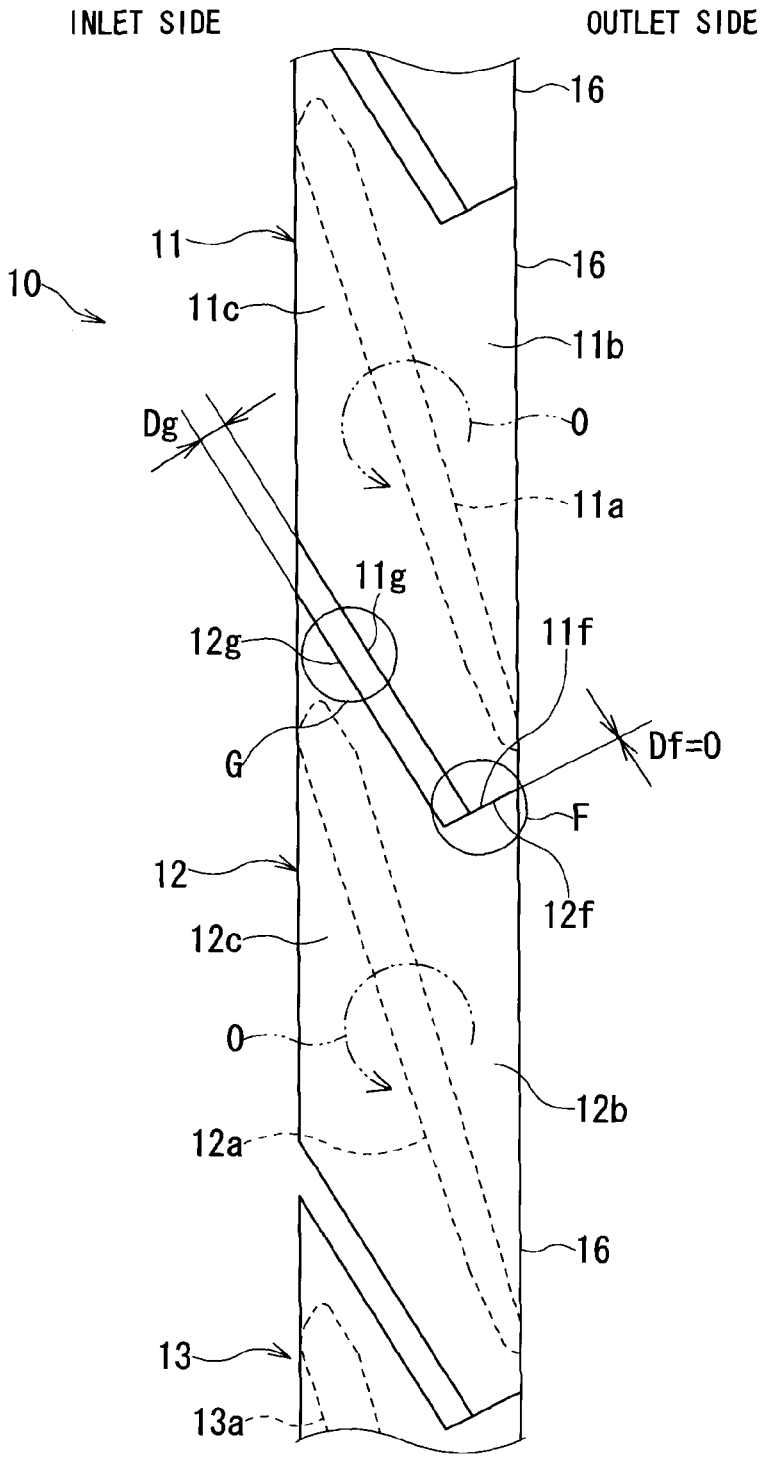
FIG. 4 is an illustration of a front elevational view showing a state of rotating at a rated rotor speed in the plurality of shrouds of the turbine moving blade assembly of FIG. 1 as viewed from the outside in the radial direction.

In a process of increasing the rotor speed of the turbine, the untwist force of the airfoil portion 15 shown by arrow O in FIGS. 2 and 4, which is generated due to the centrifugal force acting on the turbine moving blades 11, 12 . . . , causes the secondary contact face portion G so as to shift from the contacting state to the separated state, causes the secondary contact face portion G and the primary contact face portion F so as to be placed in the separated state, and thereafter, causes the primary contact face portion F so as to shift from the separated state to the contacting state as shown in FIGS. 3 and 4.

Further, on the other hand, in a process of decreasing the rotor speed of the turbine, the decrease in the untwist force of the airfoil portion 15 acting on the turbine moving blades 11, 12 . . . cause the primary contact face portion F to shift from the contacting state to the separated state, causes the primary and the secondary contact face portions F and G to be placed in the separated state, and thereafter, causes the secondary contact face portion G to shift from the separated state to the contacting state.

Figure 5A:
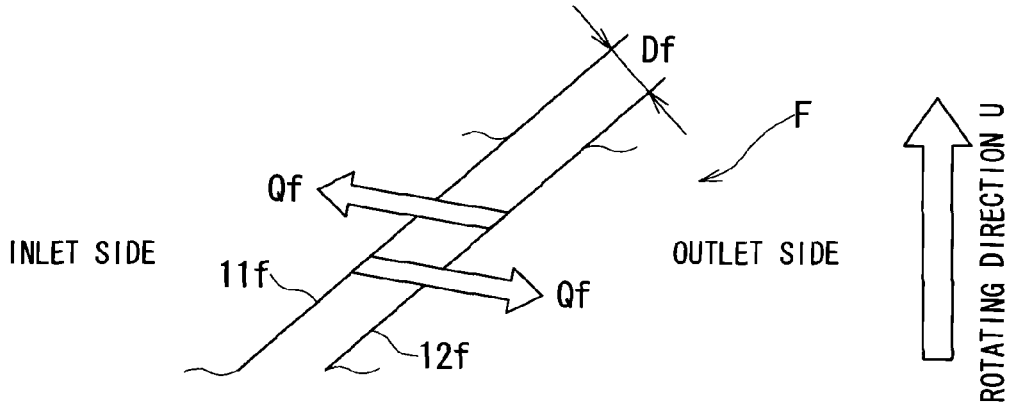
FIGS. 5A and 5B are views explaining contact face moving directions of respective contact face portions in the shrouds of FIGS. 2 to 4.

In the process of increasing the rotor speed of the turbine, since, for example, the contact faces 11*f* and 12*f*, which constitute the primary contact face portion F, are set by the untwist force of the airfoil portions 15 so as to provide the acute angle α from the turbine rotating direction U toward the outlet side in the axial direction of the rotor 14, the blades shift in a direction (arrow Qf) to be separated from each other as shown in FIG. 5A.

Figure 5B:
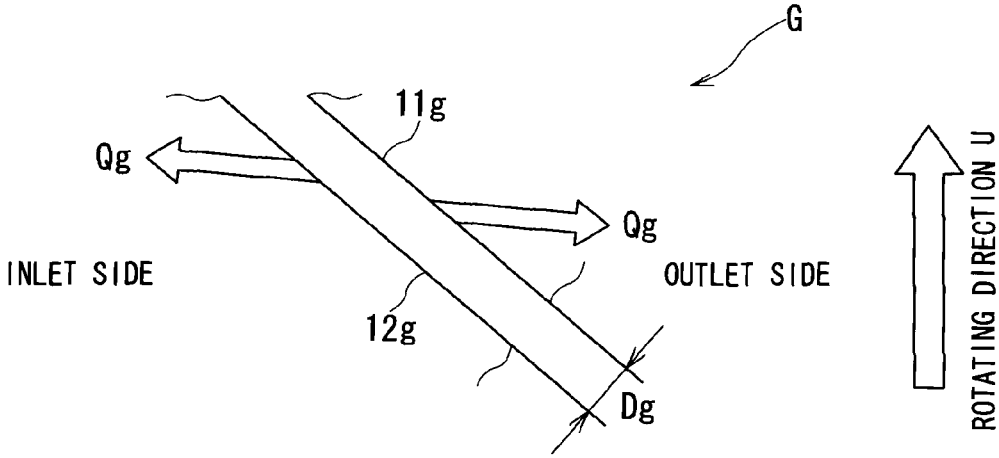

Further, since for example, the contact faces 11*g* and 12*g*, which constitute the secondary contact face portion G, is set so as to provide the obtuse angle β from the turbine rotating direction U toward the outlet side in the axial direction of the rotor 14, the blades shift in an approaching direction (arrow Qg) as shown in FIG. 5B.

Specifically, when the turbine moving blades 11, 12 . . . are assembled, in the primary contact face portion F, for example, the contact face 11*f* of the trailing side snubber 11*c* of the turbine moving blade 11 and the contact face 12*f* of the leading side snubber 12*b* of the turbine moving blade 12 adjacent to the trailing edge side of the turbine moving blade 11, which are formed so as to provide flat parallel faces facing each other, are assembled to keep predetermined gaps (assembly gaps) Df as shown in FIG. 2.

In contrast, in the secondary contact face portion G, for example, the contact face 12*g* of the leading side snubber 12*b* of the turbine moving blade 12 is assembled so as to be provided with an initial contact reaction force by coming into contact with the contact face 11*g* of the trailing side snubber 11*c* of the turbine moving blade 11 adjacent to the turbine moving blade 12.

When the rotor speed of the turbine starts to increase, in the secondary contact face portion G, the contact reaction forces of the contact face 12*g* of the leading side snubber 12*b* and the contact face 11*g* of the trailing side snubber 11*c*, which are in contact with each other, gradually reduces and becomes 0 (zero) at a predetermined rotor speed, and the contact face 12*g* starts to separate from the contact face 11*g*.

In contrast, in the primary contact face portion F, the contact face 11*f* starts to come into contact with the contact face 12*f* at a certain predetermined rotor speed, and restriction starts in the primary contact face portion F. In this event, in the secondary contact face portion G, the gap Dg is set to a predetermined value by the restriction (friction force) of the primary contact face portion F as shown in FIG. 4. Thereafter, in the primary contact face portion F, although the contact reaction force is increased as the rotor speed increases, and thus, the restriction force is increased, the gap Dg in the secondary contact face portion G is kept to the predetermined value.

Further, in an event that the rotor speed of the turbine decreases, an operation reverse to that explained above will be performed.

Figure 6:
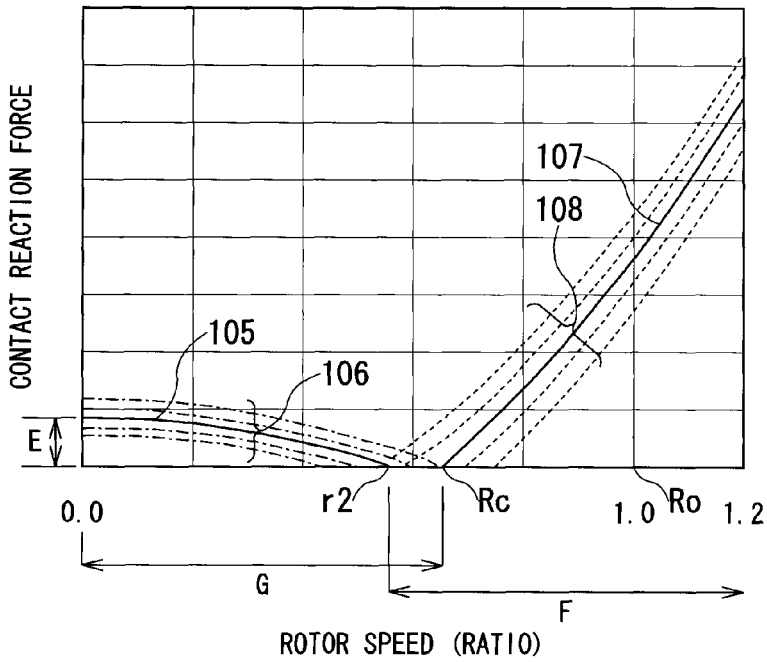
FIG. 6 is a graph showing the relationship between the contact reaction forces acting on the respective contact face portions of FIGS. 2 to 4 and the rotor speed of the turbine.

Curves 105 and 107 of FIG. 6 represent the changing states of the respective contact reaction forces of the primary and the secondary contact face portions F and G with respect to the change in the rotor speed of the turbine.

Figure 23:
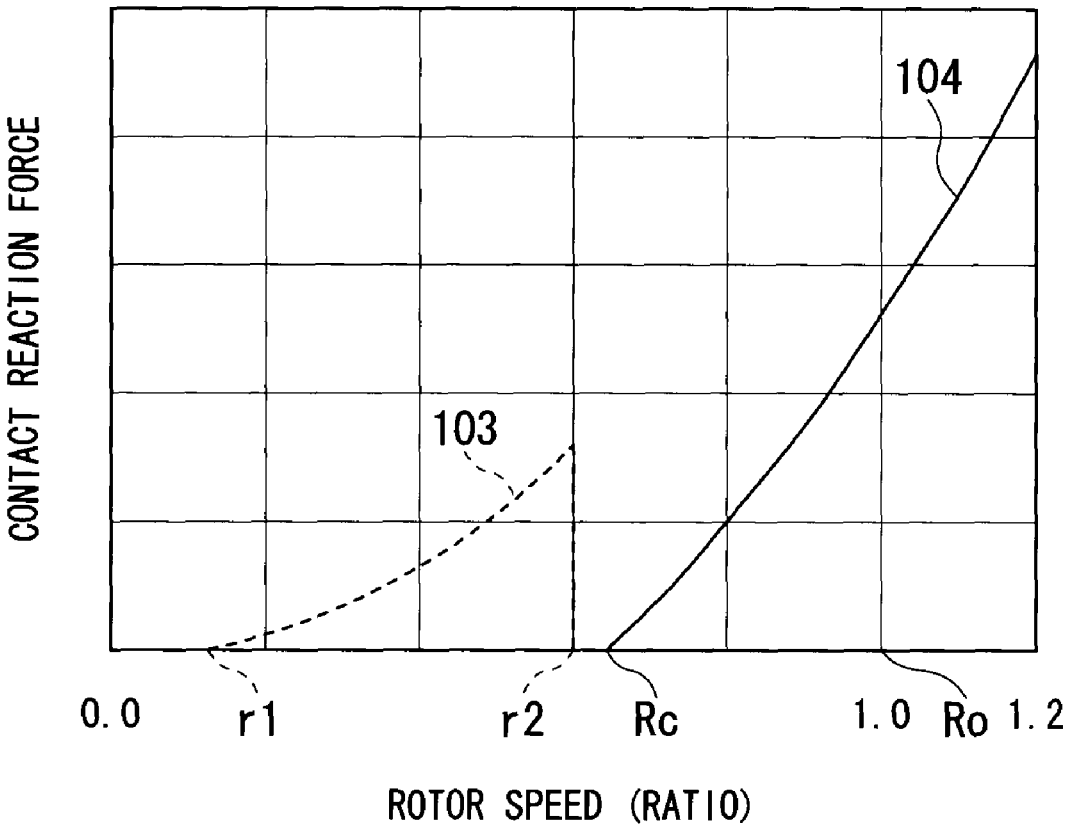
FIG. 23 PRIOR ART
FIG. 23 is a graph showing the relationship between the contact reaction forces and the rotor speed of the second to fourth conventional structures of the turbine moving blade coupling.

These graphs correspond to those of the contact reaction force characteristic curves 103 and 104 shown in FIG. 23 in the conventional technology. It is considered that the characteristics of the contact reaction force characteristic curve 107 in the primary contact face portion F of this embodiment is essentially the same as those of the contact reaction force characteristic curve 104 in the conventional technology.

However, as to the position of the contact start rotor speed Rc of the contact reaction force characteristic curve 107, in this embodiment, the behavior of separation/approach of the secondary contact face portion G is different from that of the primary contact face portion F, and the contact reaction force of the secondary contact face portion G decreases in the process of increasing the rotor speed of the turbine.

Accordingly, the contact start rotor speed Rc of the primary contact face portion F and the separation rotor speed r2 of the secondary contact face portion G can be set more freely. More specifically, in FIG. 6, a separation rotor speed r2 can be arbitrarily selected by changing a pressing force E in the assembly on the secondary contact face portion G. This means that the characteristics of the contact reaction force of the secondary contact face portion G are expressed as a curve group 106.

Further, since the contact start rotor speed Rc can be optionally set by adjusting the gap Df in the assembly also in the primary contact face portion F, the characteristics of the contact reaction force of the primary contact face portion F is expressed by a curve group 108 of FIG. 6. The values to which the separation rotor speed r2 and the contact start rotor speed Rc are set will be explained later in detail.

As described above, since the characteristics of the contact reaction forces of the primary and the secondary contact face portions F and G can be optionally selected, the continuously-coupled mode and the single blade mode can be selectively used in the wide range of rotor speed. In particular, the embodiment shown in FIG. 6 is compared with the conventional example shown in FIG. 23 with respect to the characteristics of separation and contact in the secondary contact face portion G.

The contact reaction force characteristic curve 103 of FIG. 23 in the conventional example shows that the contact reaction force gradually increases after the contacting starts in the rotor speed r1 and has a maximum value in the separation rotor speed r2. In contrast, in the contact reaction force characteristic curve 105 in FIG. 6 of the embodiment, although the pressing force E in the assembly becomes the maximum value of the reaction force, the reaction force gradually decreases from the maximum value and becomes "0" in the separation rotor speed r2.

This shows that the embodiment has more reliable characteristics because the primary contact face portion F starts to contact after the contact reaction force acting on the secondary contact face portion G is set once to "0", though, in the conventional example, the contact reaction force may not be shifted from the maximum state to the "0" state in the separation rotor speed r2 under the operation of the friction force.

Figure 7:
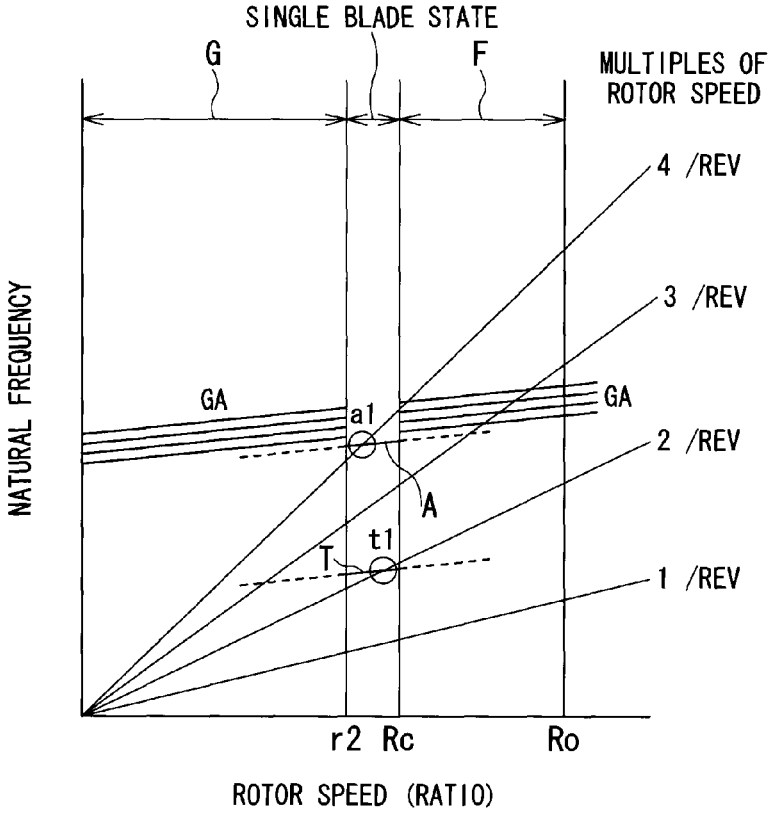
FIG. 7 is a Campbell diagram of the turbine moving blade of FIG. 1.
Figure 17A:
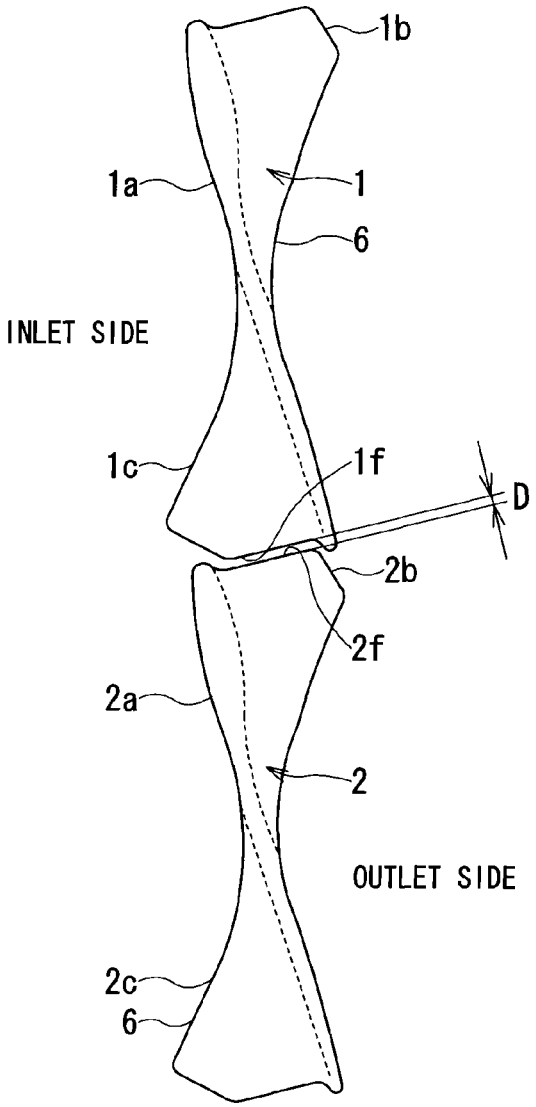
FIG. 17A PRIOR ART
FIG. 17A is a front elevational view showing a turbine stop state.
Figure 17B:
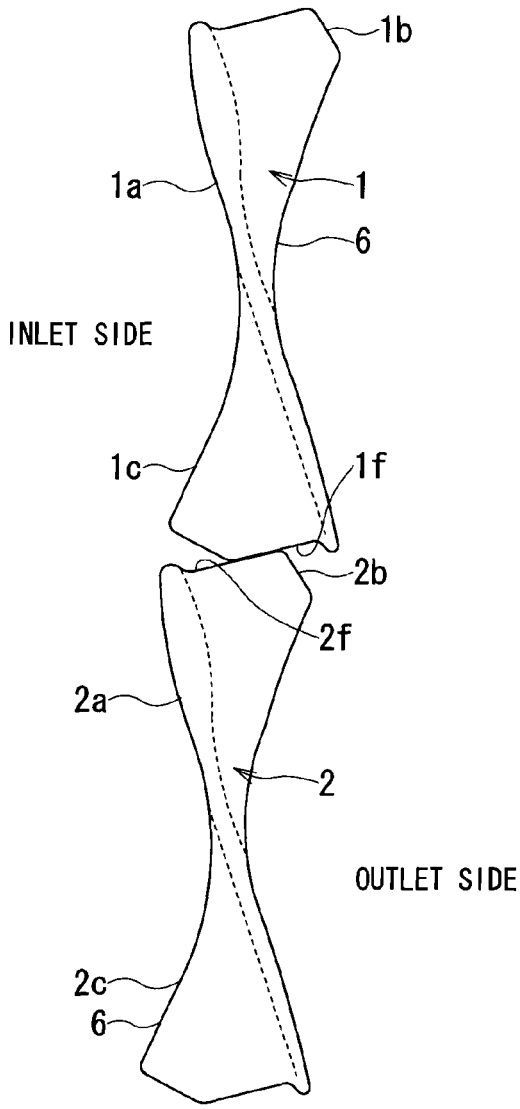
FIG. 17B PRIOR ART
FIG. 17B is a front elevational view showing a state of rotating at a rated speed.
Figure 18:
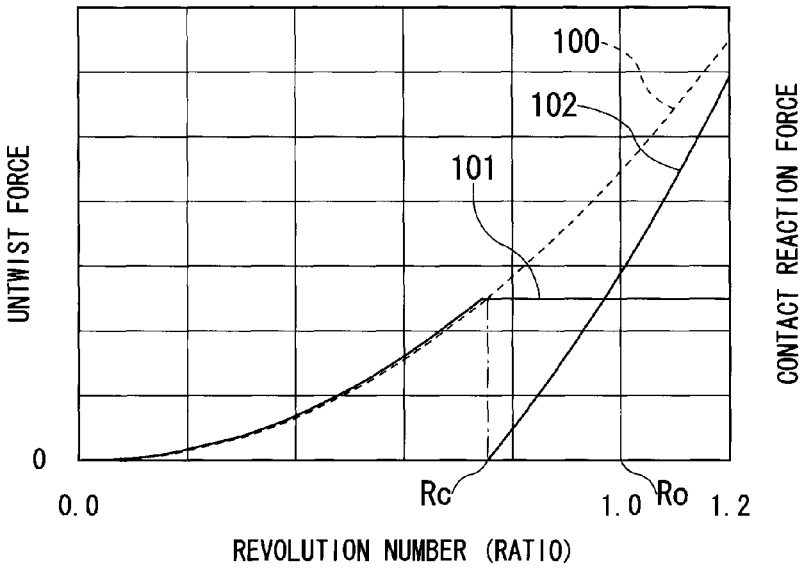
FIG. 18 PRIOR ART
FIG. 18 is a graph showing the relationship among a contact reaction force acting on the shrouds of FIG. 17, an untwist force and a rotor speed of the turbine.

FIG. 7 shows an example of a Campbell diagram of the turbine moving blades 1, 2 . . . having the turbine moving blade coupling of the embodiment described above. When the Campbell diagram of FIG. 7 is compared with the Campbell diagram (FIG. 19) of the turbine moving blades 1, 2 . . . of the conventional structure shown in FIG. 17, the operation range in the continuously-coupled mode widely expands into the lower speed range from zero speed, so that the turbine is started in the continuously-coupled mode under the contacting state of the secondary contact face portion G.

Figure 19:
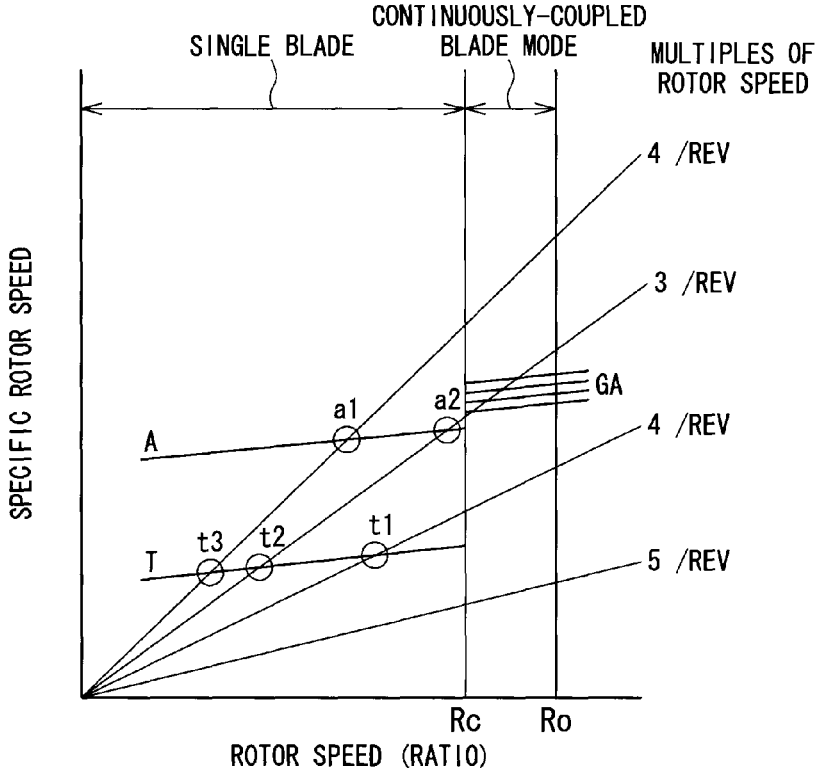
FIG. 19 PRIOR ART
FIG. 19 is a Campbell diagram of the turbine moving blades of FIGS. 16 and 17.
Figure 20A:
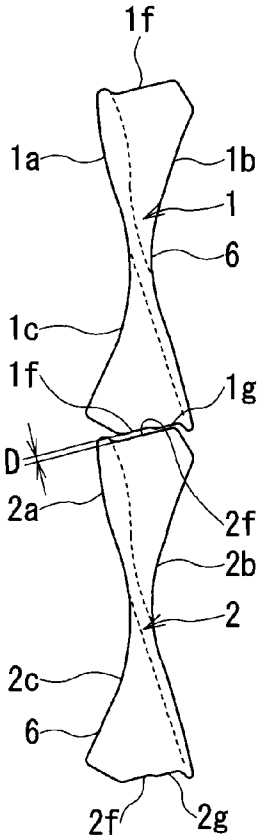
FIG. 20A PRIOR ART
FIG. 20A is a front elevational view showing a turbine stop state.
Figure 20B:
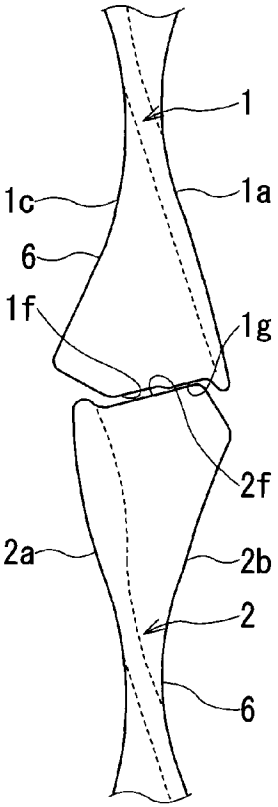
FIG. 20B PRIOR ART
FIG. 20B is a front elevational view showing a turbine rotating at a low speed.
Figure 20C:
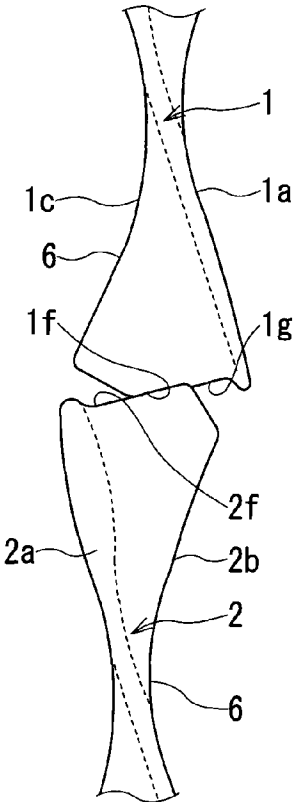
FIG. 20C PRIOR ART
FIG. 20C is a front elevational view showing a turbine rotating at a rated speed.
Figure 21A:
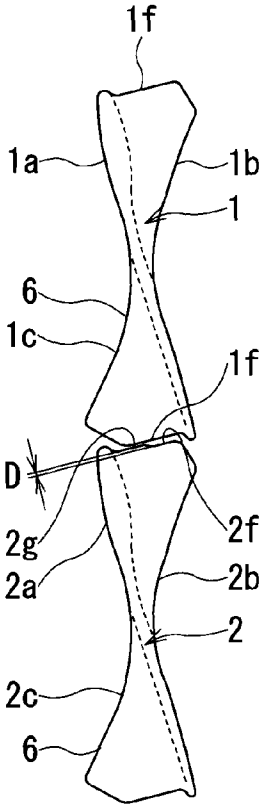
FIG. 21A PRIOR ART
FIG. 21A is a front elevational view showing a turbine stop state.
Figure 21B:
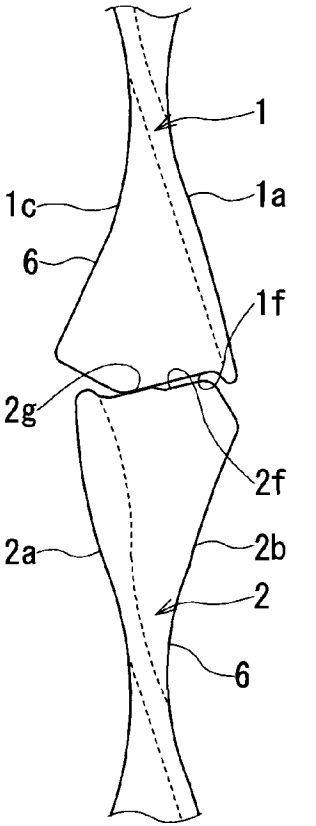
FIG. 21B PRIOR ART
FIG. 21B is a front elevational view showing a turbine rotating at a low speed.
Figure 21C:
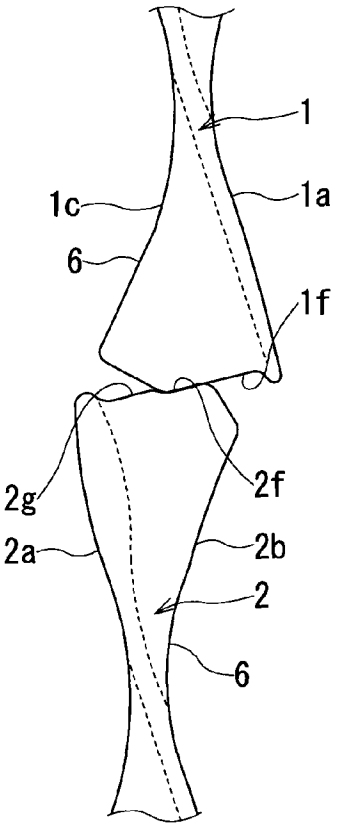
FIG. 21C PRIOR ART
FIG. 21C is a front elevational view showing a turbine rotating at a rated speed.
Figure 22C:
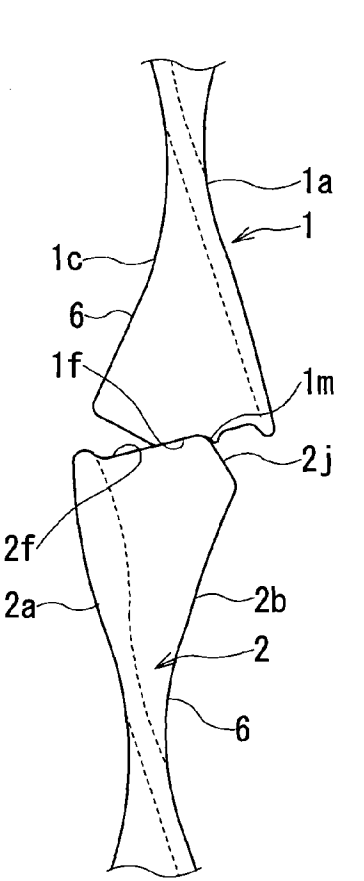
FIG. 22C PRIOR ART
FIG. 22*c* is a front elevational view showing a turbine rotating at a rated speed.
Figure 22B:
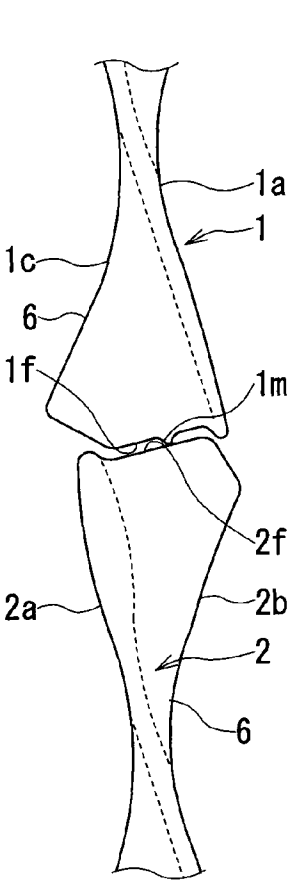
FIG. 22B PRIOR ART
FIG. 22B is a front elevational view showing a turbine rotating at a low speed.
Figure 22A:
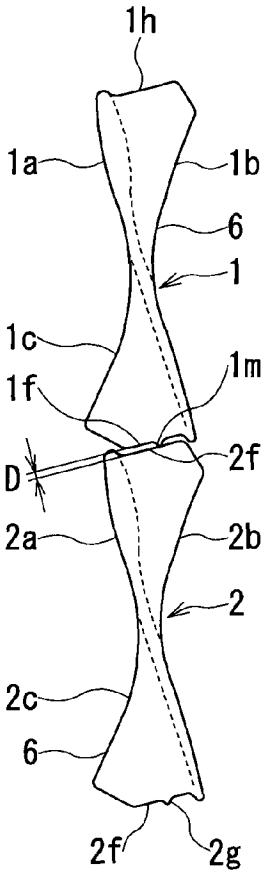
FIG. 22A PRIOR ART
FIG. 22A is a front elevational view showing a turbine stop state.
Figure 24:
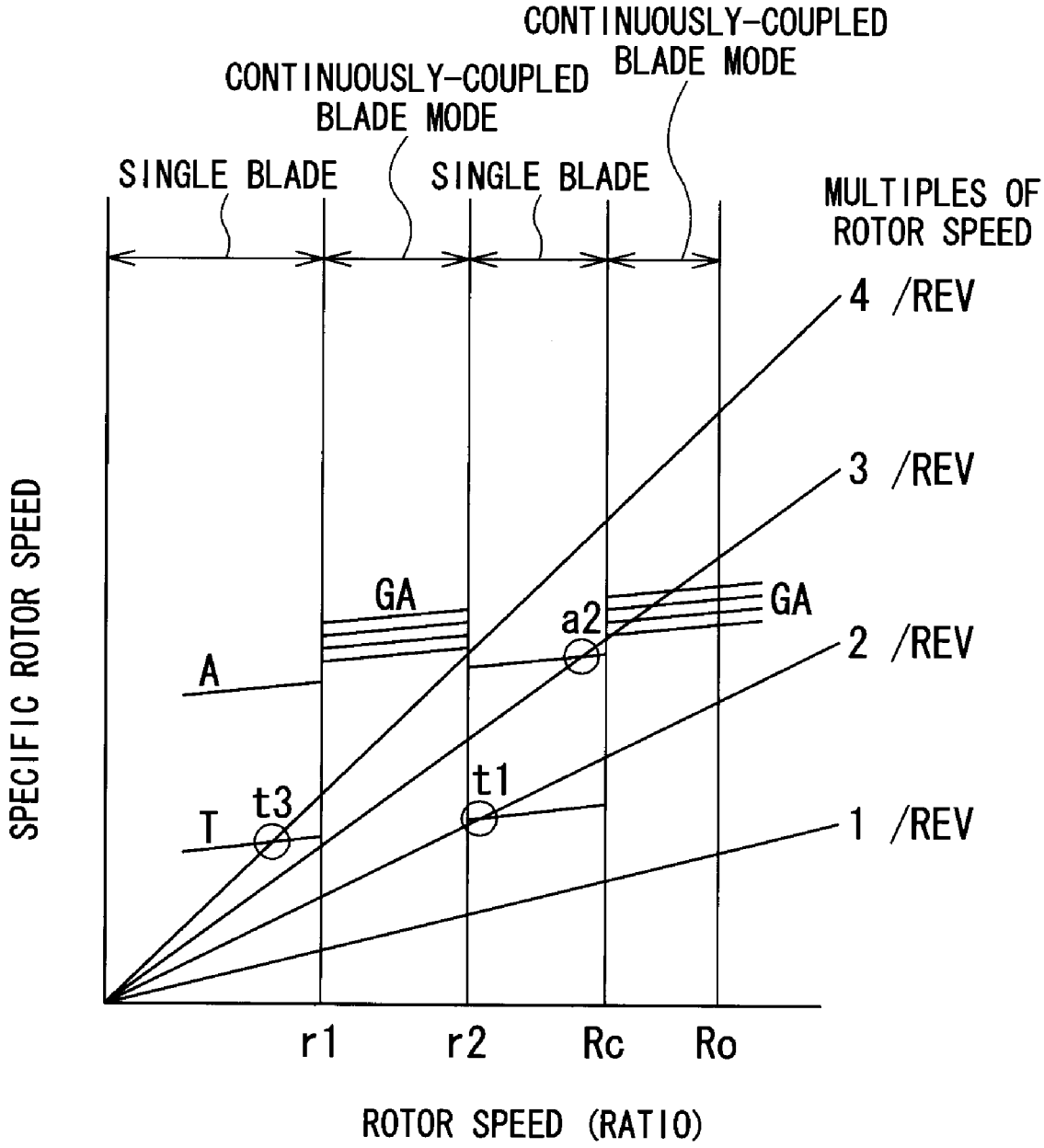
FIG. 24 PRIOR ART
FIG. 24 is a Campbell diagram of the turbine moving blades of FIGS. 20 to 22.
Figure 25:
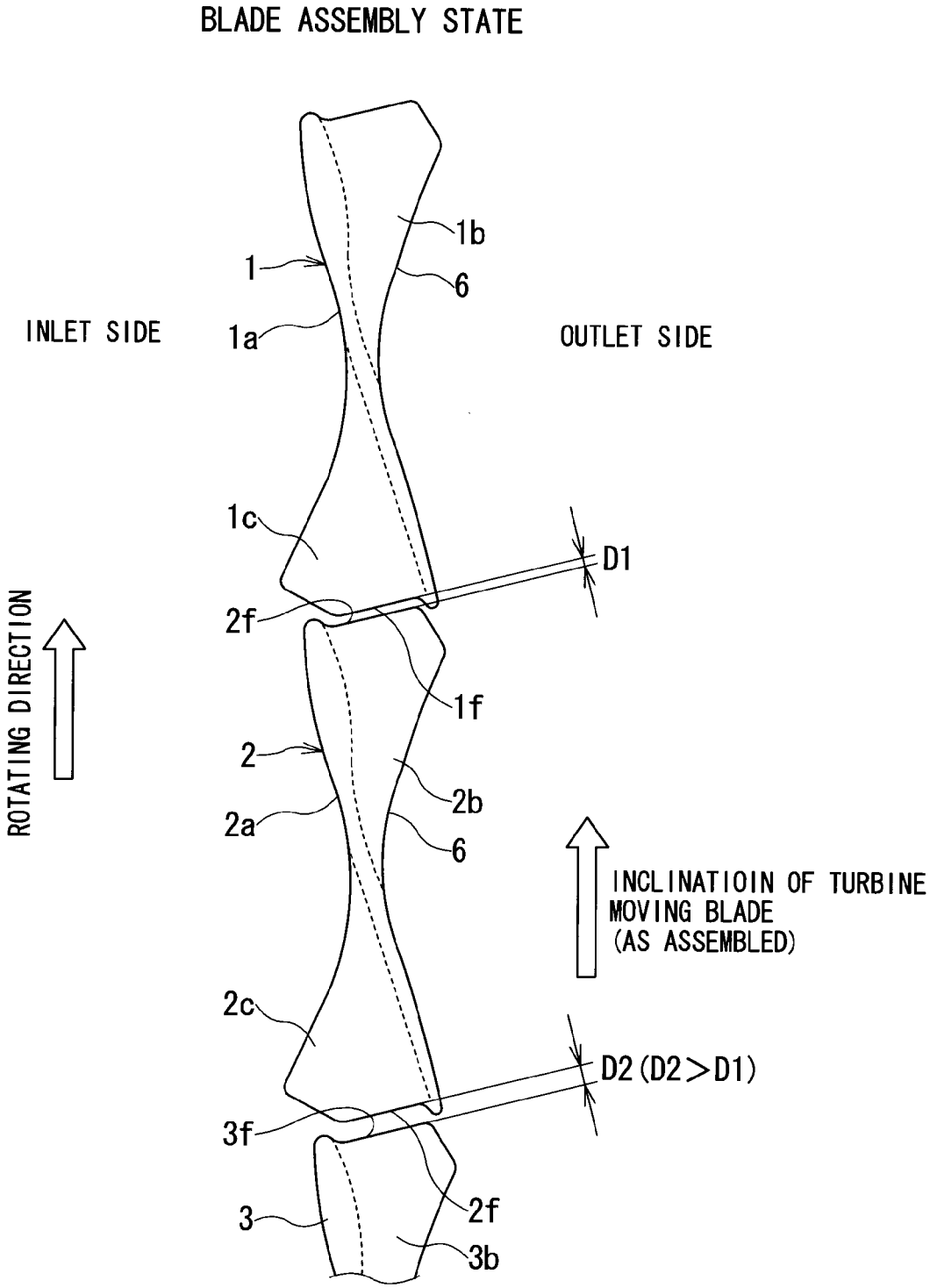
FIG. 25 PRIOR ART
FIG. 25 is an illustration of a front elevational view of the plurality of shrouds showing a case in which the contact face has a different gap in the turbine stop state in the first conventional structure of the turbine moving blade coupling shown in FIG. 17.
Figure 26:
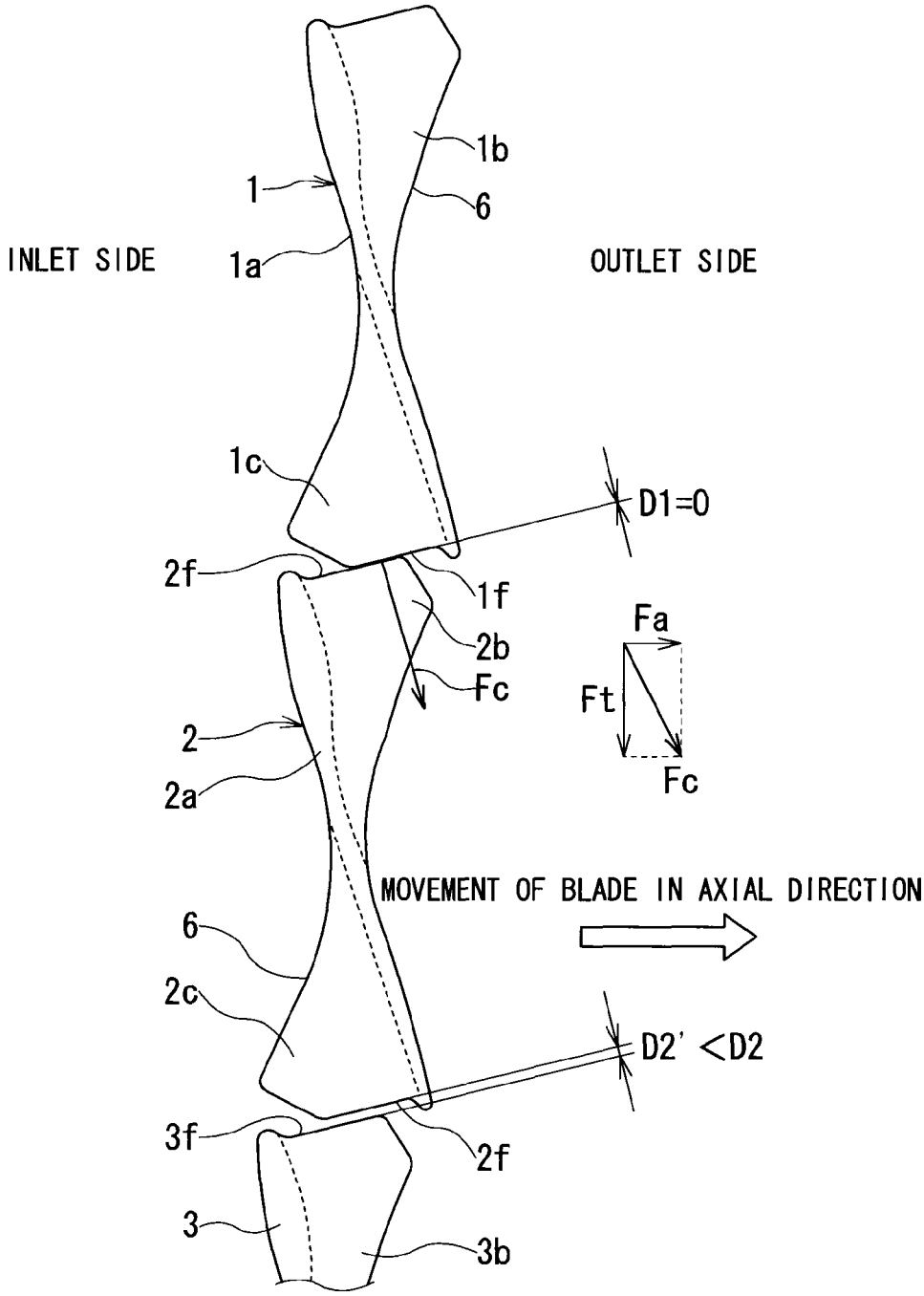
FIG. 26 PRIOR ART
FIG. 26 is an illustration of a front elevational view of the plurality of shrouds showing a state that the rotor speed reaches a contact start rotor speed of the blades 1 and 2, but not of blades 2 and 3 in the case of FIG. 25 in which the primary contact face portion has the different gap.

Further, in the Campbell diagram of the turbine moving blades 1, 2 . . . of FIGS. 20 to 22, one more continuously-coupled mode is partially added to the lower speed range in addition to the continuously-coupled mode in the higher speed range in the Campbell diagram of FIG. 19 as shown in FIG. 24. It is however impossible to stop the turbine operation in the range of the continuously-coupled mode.

In FIG. 7, since a resonant point $a_1$ of the single blade mode A in the axial direction is near the continuously-coupled mode range in the lower speed range, when the pressing force E in the assembly is increased in the contact reaction force characteristic curve 106 of FIG. 6 (i.e., when the assembling process is performed by increasing the contact reaction forces of the contact faces 11*g* and 12*g* in the secondary contact face portion G of FIG. 2), the continuously-coupled mode due to the secondary contact face portion G is expanded so as to cover the resonant point $a_1$ on FIG. 7 together with resonant points $t_2$, $t_3$ which exists in FIG. 19 of the conventional structure by shifting the separation rotor speed r2 in the secondary contact face portion G in FIG. 6 to the higher speed side, and thus, the resonant point $a_1$ can be eliminated together with the resonant points $t_2$ and $t_3$.

Furthermore, the resonant point $a_2$ in the single blade mode which exists in FIG. 19 is included in the continuously-coupled mode in the higher speed range by the contact of the primary contact face portion in FIG. 7 and is eliminated. This state can be obtained by lowering the contact start rotor speed Rc by adjusting the gap (assembly gap) Df of the primary contact face portion F in FIGS. 2 and 6. Likewise, the resonant point $t_1$ can be eliminated by lowering the contact start rotor speed Rc by adjusting the gap Df of the primary contact face portion F.

As described above, it becomes possible to avoid or suppress the high level vibration at resonant points of the single blade mode by making use of the contact reaction force characteristics of the primary and secondary contact face portions F and G shown in FIG. 6, i.e., the conversion characteristics of the blade mode, so that the reliability of the turbine moving blades 1, 2 . . . can be increased.

Hereunder, it will be explained in detail that to what value the contact start rotor speed Rc in the primary contact face portion F and the separation rotor speed r2 of the secondary contact face portion G are set.

An object of the contact by the primary contact face portion F is to avoid or suppress the high level vibration at resonant points of the single blade mode of the turbine moving blades 11, 12 . . . in the turbine higher speed range by forming the continuously-coupled mode with low level vibration by connecting all the blades in a row at the airfoil tip portion 11*a*, 12*a* . . . of the turbine moving blades 11, 12 . . . .

Simultaneously, the contact reaction force on the primary contact face portion F is prevented from being made too high. This is because that if the contact reaction force is made too high, the stress of the portions, in which the leading side snubbers 11*b*, 12*b* . . . and the trailing side snubbers 11*c*, 12*c* . . . project from the airfoil tip portion 11*a*, 12*a* . . . , is increased as described above.

Furthermore, an object of the contact by the secondary contact face portion G is to convert the single blade mode to the continuously-coupled mode by a restriction force to thereby avoid or suppress the high level vibration at resonant points of the single blade mode of the turbine moving blades 11, 12 . . . in the lower speed range.

The two contact modes in the turbine higher speed range and the turbine lower speed range can be optionally selected in a certain degree of range as described above to obtain a desired degree of restriction as shown in the contact reaction force characteristic curve groups 106 and 108 in FIG. 6.

Here, it is a matter of importance that if the contact reaction force characteristic curves selected from the contact reaction force characteristic curve groups 106 and 108 are supposed to be the curves 105 and 107, the presence of a rotor speed window Rw (the rotor speed range from the separation rotor speed r2 to the contact start rotor speed Rc in FIG. 6) is necessary. In other words, the secondary contact face portion G must reach the complete separation before the primary contact face portion F at starts contacting rotor speed Rc.

This is because when the restriction starts in the primary contact face portion F under the restricted state remained in the secondary contact face portion G, the secondary contact face portion G is restricted at the position as is located under the friction force applied condition. Then, the contact reaction force characteristic becomes the off-design condition, which will cause the abnormal reaction force on the primary contact faces at the rated rotor speed, accompanied by the increased stresses in the airfoil tip.

As mentioned above, it is known through experience that, in order to perfectly separate the secondary contact faces of portion G before the primary contact faces of portion F start to contact, the rotor speed window Rw must be set to be larger than about 5% of the rated rotor speed of the turbine by taking account of dispersions and the like.

Figure 8:
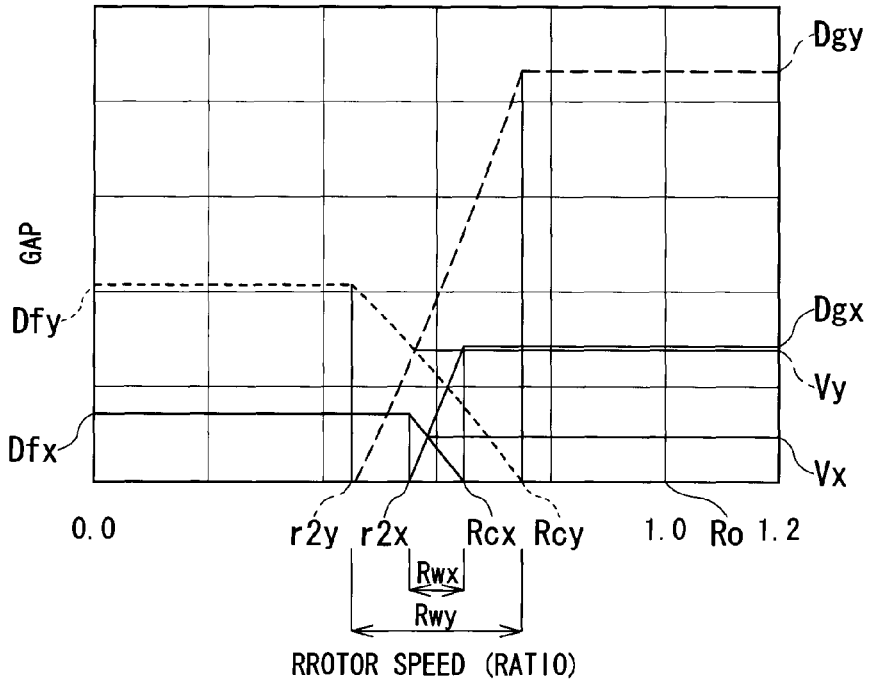
FIG. 8 is a graph showing the relationship between gaps of the respective contact face portions of FIGS. 2 to 4 and the rotor speed of the turbine.

Furthermore, FIG. 8 shows an example of comparison between a case in which the rotor speed window Rw is narrowed (suffix: x) and a case in which the window Rw is widened (suffix: y). When the assembly gap of the primary contact face portion F is shown by $Df_y$ and $Df_x$($Df_y$>$Df_x$), and the gap of the secondary contact face portion G at a rated speed is shown by $Dg_y$ and $Dg_x$ ($Dg_y$>$Dg_x$), the rotor speed window Rw is set to $Rw_y$ (the rotor speed range from the separation rotor speed $r2_y$ to the contact start rotor speed $Rc_y$) and to $Rw_x$ (the rotor speed range from the separation rotor speed $r2_x$ to the contact start rotor speed $Rc_x$) as shown in FIG. 8 correspondingly.

Further, during operating in the rotor speed window Rw without the restriction force by the contact, blades are vibrating in the single blade mode. The maximum vibration amplitude V($V_y$ and $V_x$) is the smaller value of the gaps Df and Dg increases as the rotor speed window Rw is expanded.

Accordingly, in order to suppress the vibration amplitude, the rotor speed window Rw will be made narrower. Thus, the preferable upper limit of the rotor speed window Rw, is set to be 20% of the rated rotor speed of the turbine.

In contrast, since the contact start rotor speed Rc in the primary contact face portion F is restricted by the ratio of the stress determined by the structure of the turbine moving blades 11, 12 . . . which is generated to the airfoil tip portion 11*a*, 12*a* . . . thereof in the highest rotor speed of the turbine to the magnitude of allowable stress determined by the material of the blade, it can be determined from the largest allowable reaction force using the contact reaction force characteristic curve group 108 of FIG. 6. Accordingly, the upper limit of the contact start rotor speed Rc is ordinarily set to 75% of the rated rotor speed of the turbine.

Figure 9:
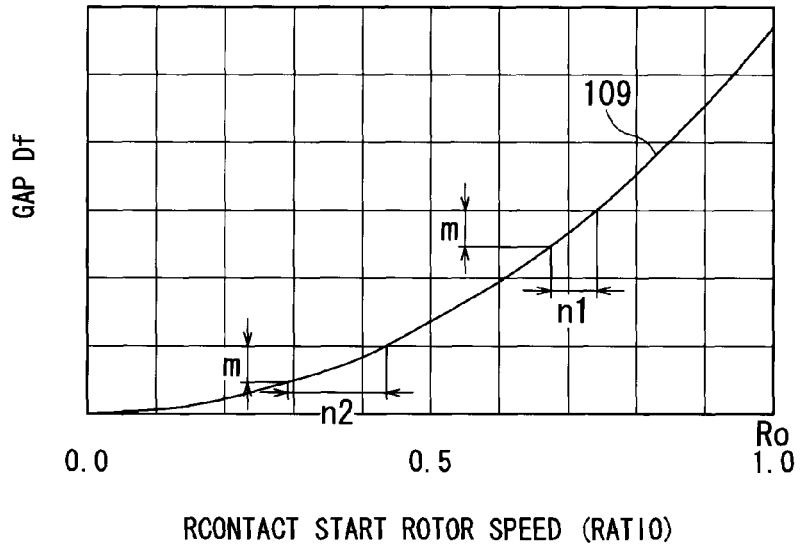
FIG. 9 is a graph showing the relationship between the assembly gap and the contact start rotor speed stop of the primary contact face portions of FIGS. 2 to 4.

FIG. 9 shows a comparison of a case in which the assembly gap Df in the primary contact face portion F is selected in the turbine lower speed range with a case in witch it is selected in the turbine higher speed range. In FIG. 9, when it is assumed that the allowable value of dispersion of the gap Df is shown by "m", the dispersion "n" of the contact start rotor speed Rc which corresponds to the gap Df can be suppressed more by n1 in the turbine higher speed range than n2 in the turbine lower speed range by the characteristics of the curve 109. The lower limit of the contact start rotor speed Rc is set to 60% of the rated rotor speed of the turbine in consideration of the dispersions of the gap Df and the contact start rotor speed Rc in the primary contact face portion F.

Accordingly, the contact start rotor speed Rc is ordinarily set to 60% to 75% of the rated rotor speed of the turbine.

When the contact start rotor speed Rc is set as described above, the optimum value of the separation rotor speed r2 in the secondary contact face portion G is set to the rotor speed which is smaller than the contact start rotor speed Rc by about 5% to 20% of the rated rotor speed of the turbine and set to the rotor speed of, for example, 50% to 65% of the rated rotor speed of the turbine because the rotor speed window Rw is 5% to 20% of the rated rotor speed of the turbine as described above.

Thus, the embodiment described above may achieve the following advantageous effects (1) to (4).

(1) Since the shift characteristics (i.e., the contact reaction force characteristic curve 105 of FIG. 6) shifted from the contacting state to the separated state of the secondary contact face portion G and the shift characteristics (i.e., the contact reaction force characteristic curve 107 of FIG. 6) shifted from the separated state to the contacting state of the primary contact face portion F can be relatively optionally selected, the continuously-coupled mode and the single blade mode of the turbine moving blades 11, 12 . . . in the wide range of rotor speed can be set most adequately.

Accordingly, vibration can be suppressed in the higher speed range as well as in the lower speed range of the turbine, in addition to that, the contact reaction force between the leading side snubbers 11*b*, 12*b*, . . . and the trailing side snubbers 11*c*, 12*c* . . . of the adjacent turbine moving blades 11, 12 . . . can be prevented from increasing too high, thereby improving the reliability of the turbine moving blades 11, 12 . . . .

(2) In particular, the gap Df or the contact start rotor speed Rc in the primary contact face portion F and the initial press force E (in assembly) in the secondary contact face portion G are appropriately selected making use of the conversion characteristics of the blade mode shown in FIG. 6 and the Campbell diagram shown in FIG. 7, and accordingly, since an operation for avoiding or suppressing the high level vibration at resonant points of the turbine moving blades 11, 12 . . . can be performed, a more reliable turbine moving blades 11, 12 . . . can be realized.

(3) Since the gap Dg is set to "0" in the secondary contact face portion G when the turbine moving blades 11, 12 . . . are assembled, this is effective as a check item when the turbine moving blades are assembled. Further, since the gap Dg of the secondary contact face portion G is set to a minute gap in the turbine lower speed range, even if the resonant vibration of turbine moving blades 11, 12 . . . occurs, the restriction effect is attainable by the collision of, for example, the contact face 11*g* against the contact face 12*g*.

(4) Since the contact start rotor speed Rc, at which the primary contact faces of portion F start contacting, is set to 60% to 75% of the rated rotor speed of the turbine in the increasing process of the rotor speed of the turbine, the high level vibration at resonant points in the single blade mode of the turbine moving blades 11, 12 . . . can be avoided by forming the continuously-coupled mode in the turbine higher speed range so that vibration can be suppressed.

Furthermore, since the separation rotor speed r2, at which the secondary contact face portion G shifts from the contacting state to the separated state, is set to the rotor speed smaller than the contact start rotor speed Rc of the primary contact face portion F by 5% to 20% of the rated rotor speed of the turbine in the increasing process of the rotor speed of the turbine and is set to, for example, the rotor speed of 50% to 65% of the rated rotor speed, the high level vibration in the single blade mode at resonant points of the turbine moving blades 11, 12 . . . can be avoided by forming the continuously-coupled mode from zero speed covering the lower speed range so that vibration can be suppressed.

Second Embodiment

FIGS. 10 to 15

Figure 10:
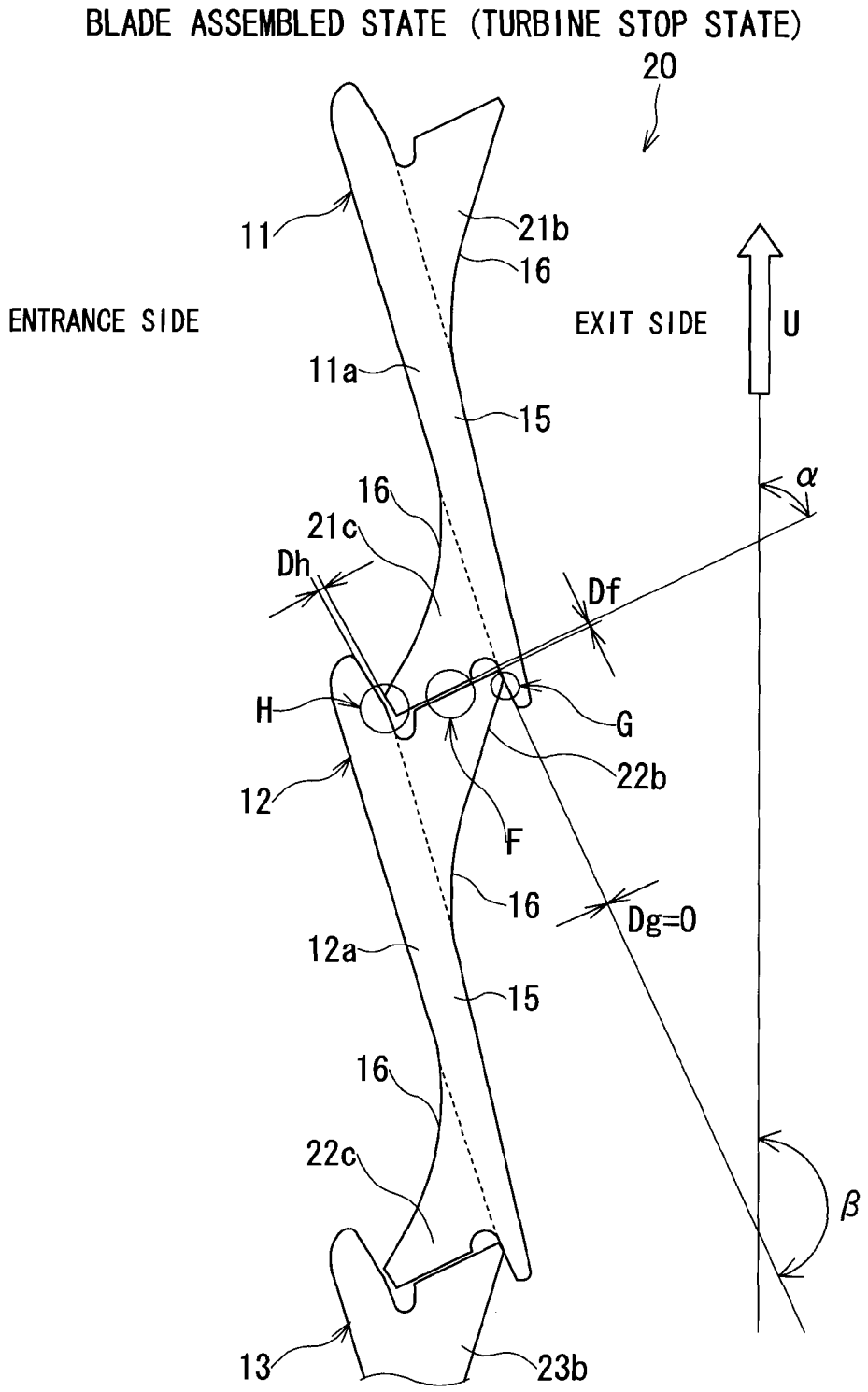
FIG. 10 is an illustration of a front elevational view showing a turbine stop state in a plurality of shrouds as viewed from the outside in the radial direction according to a second embodiment of the turbine moving blade assembly of the present invention.
Figure 11:
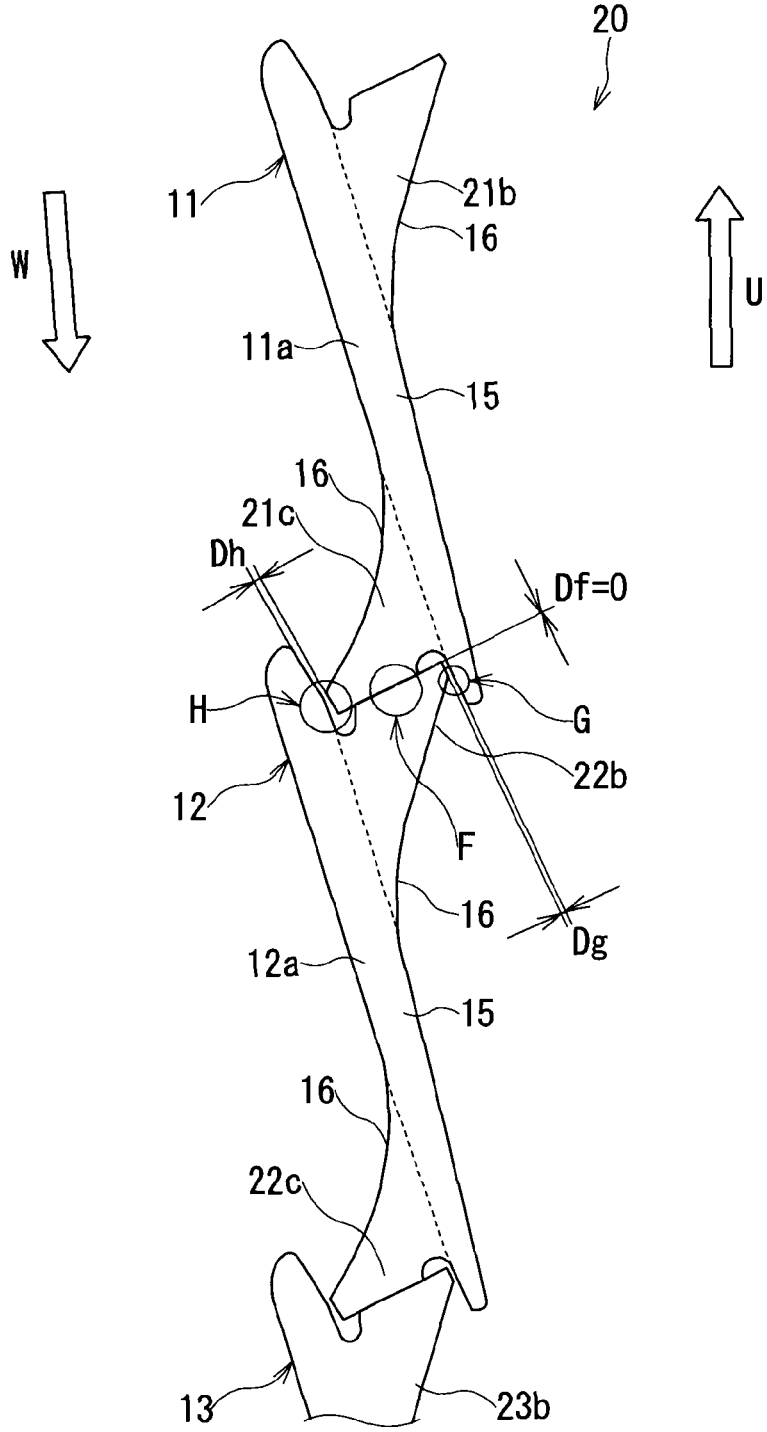
FIG. 11 is an illustration of a front elevational view showing state of rotating at a rated speed in the plurality of shrouds of FIG. 10 as viewed from the outside in the radial direction.

FIG. 10 is a front elevational view showing a turbine in a stop state of a plurality of shrouds of the turbine moving blade assembly according to the second embodiment of the present invention as viewed from the outside in a radial direction, and FIG. 11 is a front elevational view showing a turbine rated revolution state in the plurality of shrouds of FIG. 10 as viewed from the outside in a radial direction.

In the second embodiment, the same portions as those of the first embodiment are briefly explained and detailed explanation thereof is omitted by applying the same reference numerals.

A turbine moving blade assembly 20 in the second embodiment is different from the turbine moving blade assembly 10 of the first embodiment in the points (1) leading side snubbers 21*b*, 22*b* . . . project to and are formed integrally with only the portions on a turbine rotating direction U side in the suction sides of airfoil tip portions 11*a*, 12*a* . . . in respective airfoil portions 15 of turbine moving blades 11, 12 . . . , (2) trailing side snubbers 21*c*, 22*c* . . . project to and are formed integrally with only the portions opposite to the turbine rotating direction U in the pressure side of the airfoil tip portions 11*a*, 12*a* . . . , (3) the primary and the secondary contact face portions F and G are formed to a coupling composed of the leading side snubbers 21*b*, 22*b* . . . , the trailing side snubbers 21*c*, 22*c* . . . and the airfoil tip portions 11*a*, 12*a* . . . , and in addition, (4) an adjacent blade proximal face portion H is formed.

More specifically, in the first embodiment, the contact faces 11*f*, 12*f*, which constitute the primary contact face portion F as the coupling, and the contact faces 11*g*, 12*g*, which constitute the secondary contact face portion G, are disposed to the shroud portions, respectively.

In the second embodiment, however, the contact face, which constitutes a second contact face portion G on a trailing edge side in the coupling, is not disposed to shroud portions but disposed near the trailing edge of pressure side of the airfoil tip portion 11*a*, 12*a* . . . .

More specifically, in the second embodiment, the primary and secondary contact face portions F and G as the couplings are disposed to a blade tip portion including shrouds 16 such as the leading side snubbers 21*b*, 22*b*, the trailing side snubbers 21*c*, 22*c* and the like and the airfoil tip portion 11*a*, 12*a* . . . so as to confront with the blade tip portion (i.e., portions including the shrouds 16 and the airfoil tip portion 11*a*, 12*a* . . . ) of the turbine moving blades 11, 12, 13, which have respective contact faces adjacent to each other in a circumferential direction.

Furthermore, in the first embodiment, the primary contact faces 11*f*, 12*f* disposed to the leading side snubbers 21*b*, 22*b* and the trailing side snubbers 21*c*, 22*c* as a blade tip portion are disposed more on the outlet side in the axial direction of the turbine rotor 14 (rotor) than the secondary contact faces 11*g*, 12*g*. In the second embodiment, however, the contact faces, which constitute the primary contact face portion F disposed to the blade tip portion, are disposed more on the inlet side in the axial direction of a turbine rotor 14 (rotor) than the contact faces which constitute the secondary contact face portion G, respectively.

Figure 12A:
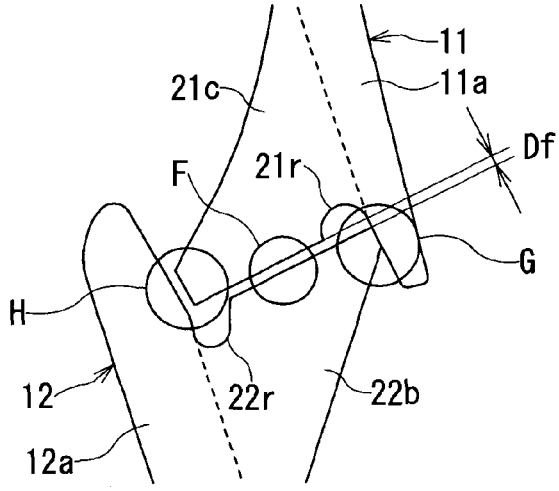
FIG. 12A is a view, in an enlarged scale, of a portion of FIG. 10, and FIGS. 12B, 12C and 12D are views, in enlarged scales, showing the primary contact face portion, the secondary contact face portion and an adjacent blade proximal face portion, respectively, in FIG. 12A.
Figure 12B:
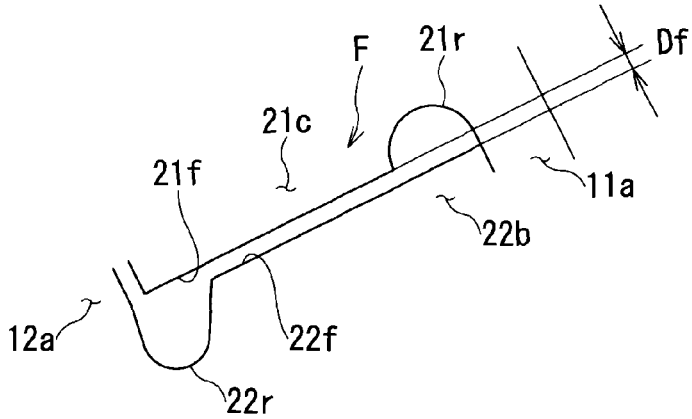
Figure 12D:
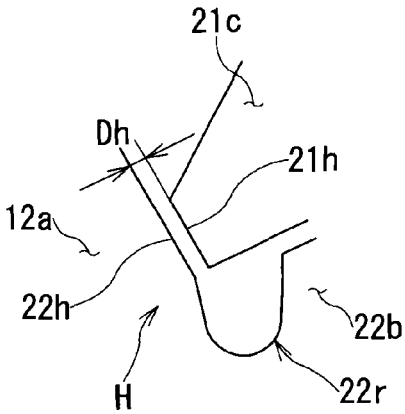

More in detail, the primary contact face portion F is formed of a contact face 22*f*, which is the leading edge side end face of the leading side snubber 22*b* in an arbitrary turbine, for example, the turbine moving blade 12 in the turbine moving blades 11, 12 . . . , and a contact face 21*f* which is the trailing edge side end face of the trailing side snubber 21*c* of, for example, the turbine moving blade 11 adjacent to the leading edge side of the turbine moving blade 12 (FIG. 12B).

These contact faces 22*f* and 2 if create an acute angle α from the rotating direction U of the turbine toward the outlet side in the axial direction of the turbine rotor 14 thereof as viewed from the outside in the radial direction so as to provide facing flat shapes.

Further, in the second embodiment, recesses 22*r*, 21*r* are further formed to, for example, the airfoil tip 12*a* side of the contact face 22*f* of the leading side snubber 22*b* that constitutes the primary contact face portion F and to the airfoil tip 11*a* side of the contact face 21*f* of the trailing side snubber 21*c* to relax stress concentration caused by the contact reaction force caused by the contact between the contact faces 21*f*, 22*f*.

Figure 12C:
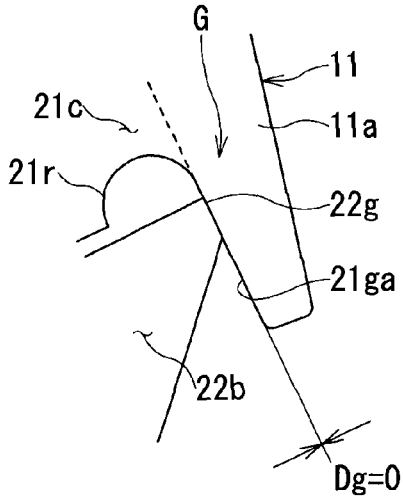

Further, the secondary contact face portion G is provided with a projecting portion tip face 22*g* of the leading side snubber 22*b* of an arbitrary turbine blade, for example, the turbine moving blade 12 in the turbine moving blades 11, 12 . . . , which is disposed on the further outlet side in the axial direction of the turbine rotor 14 (rotor) than the contact face 22, and also provided with a trailing edge pressure side face 21*ga* of the airfoil tip 11*a* of, for example, the turbine moving blade 11 adjacent to the leading edge side of the turbine moving blade 12 (FIG. 12C).

The projecting portion tip face 22*g* and the pressure side face 21*ga* near trailing edge as the contact faces create an obtuse angle β from the rotating direction U toward the outlet side in the axial direction of the turbine rotor 14 thereof as viewed from the outside in the radial direction so as to provide facing flat shapes. Further, in FIGS. 11, 12, the axial direction of the turbine rotor 14 corresponds to a direction perpendicular to the rotating direction U.

In a state that the turbine blades 11, 12 . . . are assembled in the turbine stop, a gap Df is formed between the contact face 2 if and the contact face 22*f* which form the primary contact face portion F so that both the contact faces 21*f*, 22*f* are separated from each other.

Furthermore, the trailing edge pressure side face 21*ga* and the projecting portion tip face 22*g*, which constitute the secondary contact face portion G, are provided in the contacting state when the turbine moving blades 11, 12 . . . are assembled, and a gap Dg between the pressure side face 21*ga* near the trailing edge and the projecting portion tip face 22*g* is set to Dg=0. Further, in this assembled state, the pressure side face 21*ga* near the trailing edge is pressed against the projecting portion tip face 22*g*, and a contact reaction force is generated to the trailing edge pressure side face 21*ga* and the projecting portion tip face 22*g*.

Then, in the process of increasing the rotor speed of the turbine, the untwist force of the airfoil portions 15 which is caused by the centrifugal force acting on the turbine moving blades 11, 12 . . . causes the secondary contact face portion G to shift from the contacting state to the separated state, causes the secondary contact face portion G and the primary contact face portion F to be placed in the separated state, and thereafter, causes the primary contact face portion F to shift from the separated state to the contacting state as shown in FIG. 11.

Furthermore, in the process of decreasing the rotor speed of the turbine, the decrease in untwist force of the airfoil portions 15 acting on the turbine moving blades 11, 12 . . . causes the primary contact face portion F to shift from the contacting state to the separated state, causes the primary contact face portion F and the secondary contact face portion G to be placed in the separated state, and thereafter, causes the secondary contact face portion G to shift from the separated state to the contacting state.

Specifically, when the turbine moving blades 11, 12 . . . are assembled, for example, the contact face 21*f* of the trailing side snubber 21*c* of the turbine moving blade 11 and the contact face 22*f* of the leading side snubber 22*b* of the turbine moving blade 12 adjacent to the trailing edge side with respect to the turbine moving blade 11, having the facing flat parallel faces, are assembled so as to keep the predetermined assembly gaps Df in the primary contact face portion F as shown in FIGS. 12A and 12B.

In contrast, the secondary contact face portion G is assembled in a state of being provided with an initial contact reaction force by, for example, causing the projecting portion tip face 22*g* of the leading side snubber 22*b* of the turbine moving blade 12 to come into contact with the pressure side face 21*ga* near the trailing edge of the airfoil tip 11*a* of the turbine moving blade 11 as shown in FIGS. 12A and 12C.

When the rotor speed of the turbine starts to increase, the contact reaction force of the projecting portion tip face 22*g* of the leading side snubber 22*b* and the trailing edge pressure side face 21*ga* of the airfoil tip 11*a* of the turbine moving blade 11, which are in contact with each other, gradually decreases and then becomes "0" (zero) in a certain predetermined rotor speed in the secondary contact face portion G, and thus, the projecting portion tip face 22*g* starts to separate from the pressure side face 21*ga* near the trailing edge.

Figure 13A:
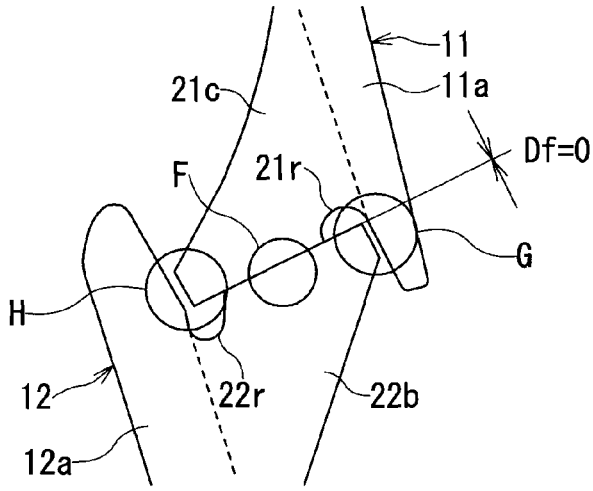
FIG. 13A is a view, in an enlarged scale, of a portion of FIG. 11, and FIGS. 13B, 13C and 13D are views, in enlarged scales, showing the primary contact face portion, the secondary contact face portion and an adjacent blade proximal face portion, respectively, in FIG. 13A.
Figure 13B:
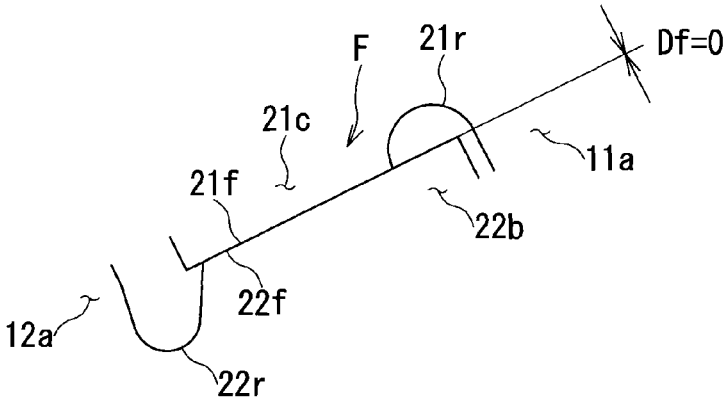

In contrast, in the primary contact face portion F, the contact face 2 if of the trailing side snubber 21*c* starts to come into contact the contact face 22*f* of the leading side snubber 22*b* in a certain predetermined rotor speed as shown in FIGS. 13A and 13B, and the restriction by the primary contact face portion F starts. At this rotor speed, in the secondary contact face portion G, the gap Dg is kept to a predetermined value by the restriction of the primary contact face portion F as shown in FIGS. 13A and 13C. In a process in which the rotor speed of the turbine further increases, although the contact reaction force increases in the primary contact face portion F, the gap Dg of the secondary contact portion G is kept to the predetermined value. Further, when the rotor speed of the turbine decreases, the turbine performs the behavior opposite to that explained hereinbefore.

Incidentally, in the respective steps of manufacturing, assembling and operating the turbine components or parts including the turbine moving blades 11, 12 . . . , it is indispensable that dispersion from an ideal state may occur in a certain degree. For example, the small dispersion in bending and twist deformation of the turbine moving blades 11, 12 . . . , which occurs in the manufacturing process, causes dispersion of the gap between adjacent parts when the turbine moving blades 11, 12 . . . , are assembled.

Figure 14:
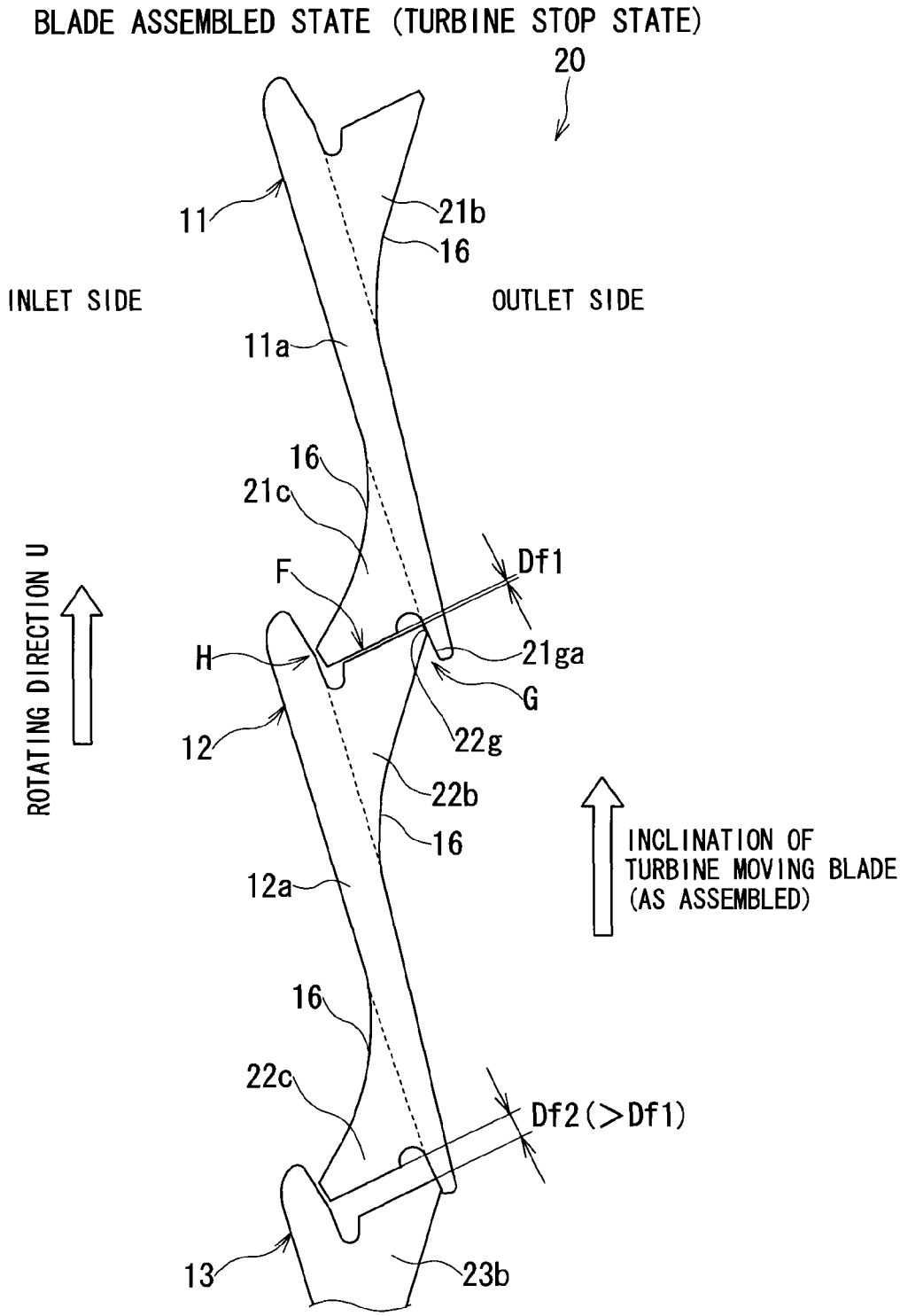
FIG. 14 is an illustration of a front elevational view of a plurality of shrouds corresponding to FIG. 10 (turbine stop state) showing a case in which the primary contact face portion has a different gap.

Here, consideration will be made on a case, in which the above-mentioned dispersion occurs in the primary contact face portion F when the turbine moving blades 11, 12 . . . , are assembled. That is, it is assumed, for example, that the turbine moving blade 12 is slightly inclined toward the turbine moving blade 11 side by the dispersion of the assembled state of the turbine moving blades 11, 12 . . . and the gap $Df_2$ of the primary contact face portion F on the trailing edge side of the turbine moving blade 12 becomes larger than the gap $Df_1$ of the primary contact face portion F on the leading edge side of the turbine moving blade 12 as shown in FIG. 14.

Figure 15:
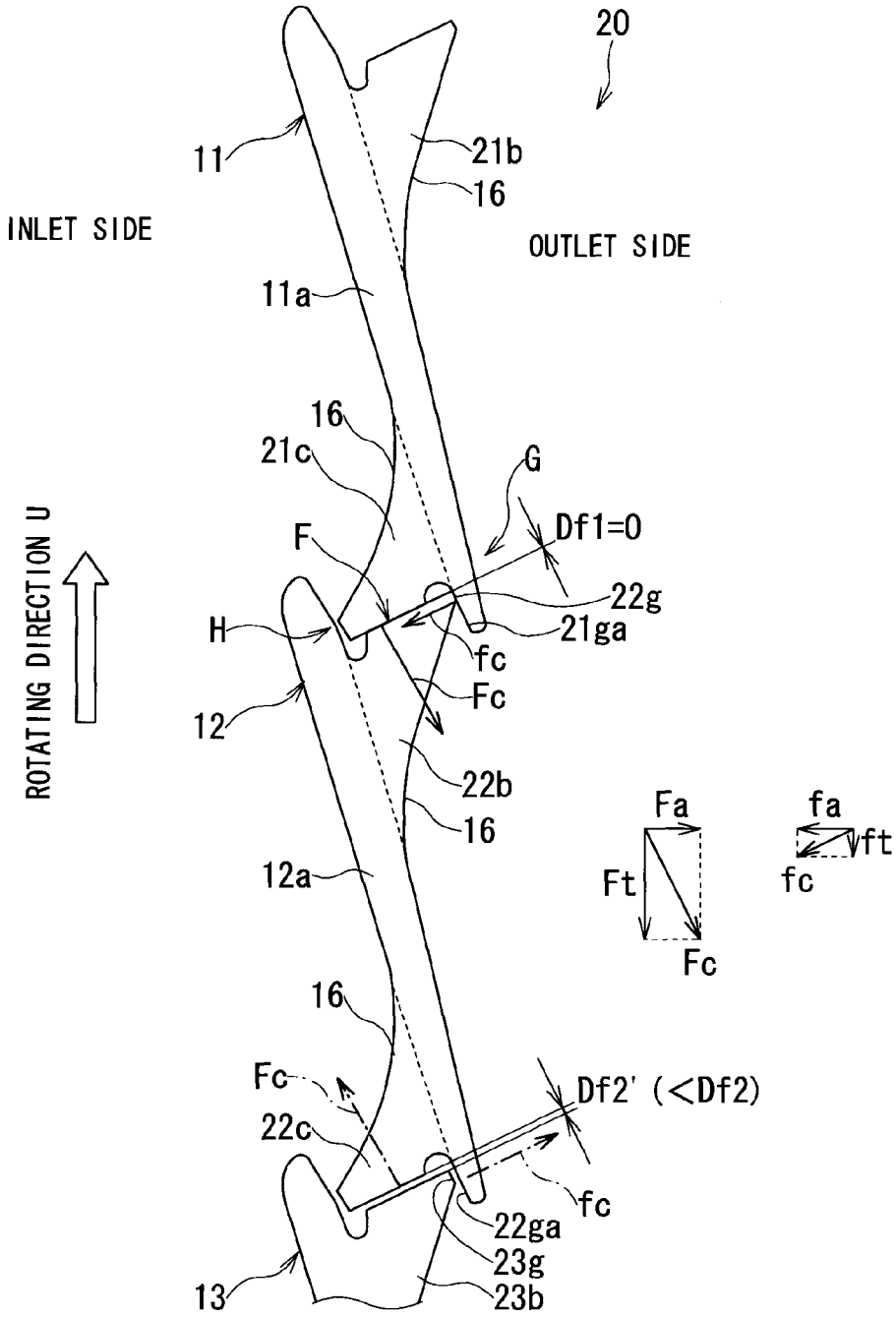
FIG. 15 is an illustration of a front elevational view of the plurality of shrouds showing a state that the rotor speed reaches a contact start rotor speed of the blades 1 and 2, but not of blades 2 and 3 in the case of FIG. 14 in which the primary contact face portion has the different gap.
Figure 16:
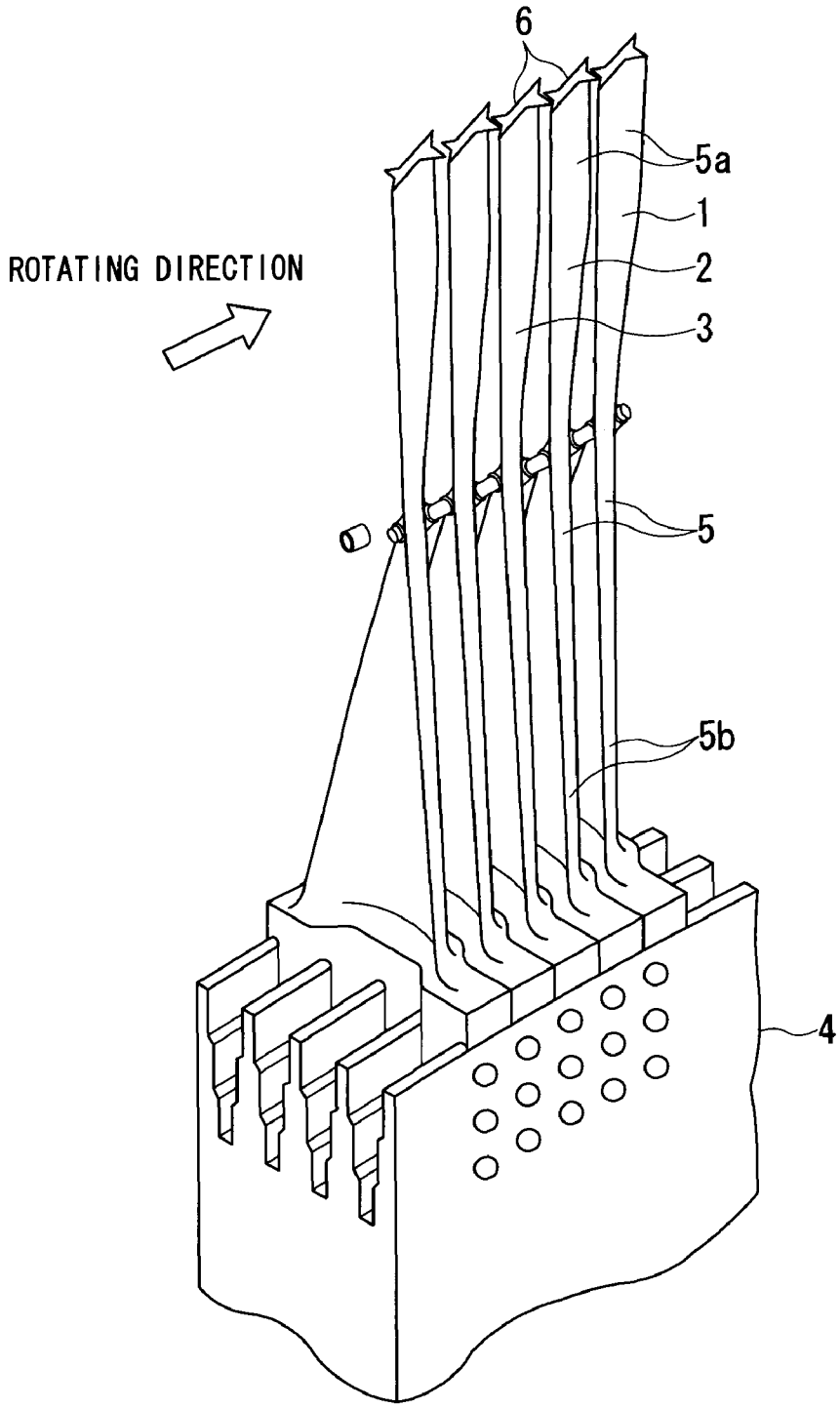
FIG. 16 PRIOR ART
FIG. 16 is a perspective view showing an assembled state of turbine moving blades having a first conventional structure of a turbine moving blade coupling.

When the rotor speed of the turbine increases in this state, the primary contact face portion F on the gap $Df_1$ side starts to contact in the state as shown in FIG. 15, the contact reaction force Fc acts on the contact face 22*f* in the leading side snubber 22*b* of the turbine moving blade 12, and an axial component Fa of the contact reaction force Fc acts in a direction where the turbine moving blade 12 is pushed towards the outlet side in the axial direction.

However, when the force Fa pushes the secondary contact face 21*ga* in the axial direction, the contact reaction force fc against Fa acts on the projecting portion end 22*g*, and the axial component fa of the contact reaction force fc, acts to cancel the axial component Fa. Then, the turbine moving blade 12 does not move towards the outlet side in the axial direction.

Furthermore, the circumferential component ft of the contact reaction force fc in the secondary contact face portion G as well as the circumferential component Ft of the contact reaction force Fc acts in a direction opposite to the turbine rotating direction U (turbine moving blade 13 side), in which the inclination of the turbine moving blade 12 to the rotating direction U side is corrected until the primary contact face of blade 12 come into contact with blade 13.

On the other hand, in a case the turbine moving blade 12 is slightly inclined to the turbine moving blade 13 side and the gap $Df_1$ of the primary contact face portion F on the leading edge side of the turbine moving blade 12 is larger than the gap $Df_2$ of the primary contact face portion F on the trailing edge side of the turbine moving blade 12, the primary contact face portion F on the gap $Df_2$ side starts to contact as the rotor speed increases. The contact reaction force Fc (shown by a dash-dot-dash-line of FIG. 15) from the leading side snubber 23*b* of the turbine moving blade 13 acts on the trailing side snubber 22*c* of the turbine moving blade 12, and the axial component of the contact reaction force Fc acts towards the inlet side in the axial direction thereof.

Then, the axial component of the contact reaction force fc cancels the axial component of the contact reaction force Fc, the turbine moving blade 12 is suppressed from moving in the axial direction thereof. Furthermore, the circumferential component of the contact reaction force fc in the secondary contact face portion G as well as the circumferential component of the contact reaction force Fc acts in a direction to the turbine rotating direction U (turbine moving blade 11 side), in which the inclination of the turbine moving blade 12 to the opposite side of rotating direction U is corrected until the primary contact face of blade 12 come into contact with blade 11.

Incidentally, an adjacent blade proximal face portion H shown in FIGS. 10 and 11 includes a projecting portion end face 21*h* (FIG. 12D and FIG. 13D) and a suction side face 22*h* near the leading edge of the airfoil tip 12*a* in the turbine moving blade 12 (FIG. 12D and FIG. 13D) so as to provide a gap Dh.

The projecting portion end face 21*h* is disposed on the further inlet side in the axial direction of the turbine rotor 14 (rotor) than the contact face 21*f*, which constitutes the primary contact face portion F of the trailing side snubber 21*c* forming the primary contact face portion F of an arbitrary turbine, for example, the turbine moving blade 11 in the turbine moving blades 11, 12 . . . , and the suction side face 22*h* near the leading edge is located adjacent to the trailing edge side of the turbine moving blade 11.

The gap Dh, which is formed by the projecting portion end face 21*h* and the suction side face 22*h* near the leading edge of the adjacent blade proximal face portion H confronting with each other, is set to a predetermined value at the rated rotor speed of the turbine of the turbine moving blades 11, 12 . . . and also set to a small value other than "0" in the turbine assembled state.

Figure 13D:
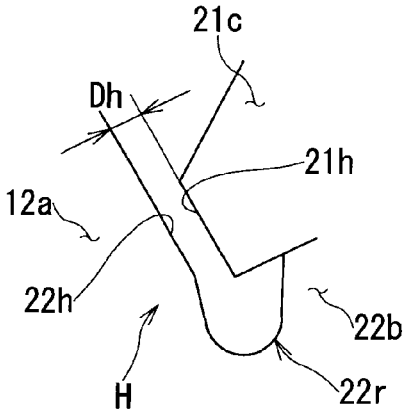
Figure 13C:
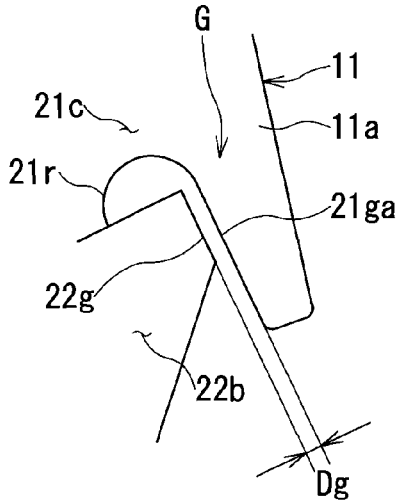

In the adjacent blade proximal face portion H, for example, the trailing side snubber 21*c* of the turbine moving blade 11 which acts as an erosion shield member can suppress the erosion growth caused by the collision of drain (in an arrow W direction of FIG. 11) which is liable to occur to the projecting portion root portion 22*r* (which is the same as the recess 22*r* described above) in the leading side snubber 22*b* of the turbine moving blade 12 as shown in FIGS. 13A and 13D and which flies in a circumferential direction.

As shown in FIGS. 10 and 12, since the adjacent blade proximal face portion H appears on the outside faces of the turbine moving blades 11, 12 . . . together with the primary and secondary contact face portions F and G in the assembled state of the turbine moving blades 11, 12 . . . , the respective gap values of the primary contact face portion F, the secondary contact face portion G, and the adjacent blade proximal face portion H can be simply measured. Thus, the dispersion of the primary contact face portion F, the secondary contact face portion G, and the adjacent blade proximal face portion H can be easily measured when they are preliminary assembled. Based on the result of the measurement, the correction can be appropriately performed, and there can be provided a more reliable turbine in which the dispersions of the respective gaps of the primary contact face portion F, the secondary contact face portion G, and the adjacent blade proximal face portion H are made minimum.

As mentioned above, the second embodiment of the structures and characteristics mentioned above will achieve the following advantageous effects (5) to (8) in addition to the advantageous effects similar to those (1) to (4) of the first embodiment.

(5) Since one of the contact faces in the secondary contact face portion G constitutes the pressure side face near the trailing edge of the airfoil tip portion 11*a*, 12*a* . . . in the turbine moving blades 11, 12 . . . , for example, the pressure side face 21*ga* near the trailing edge of the airfoil tip 11*a*, the leading side snubbers 21*b*, 22*b* . . . and the trailing side snubbers 21*c*, 22*c* . . . can be formed with the minimum areas. For this reason, the centrifugal forces generated in the leading side snubbers 21*b*, 22*b* . . . and the trailing side snubbers 21*c*, 22*c* . . . can be significantly reduced, so that the stress in the root portions in which the snubbers project from the airfoil tip portion 11*a*, 12*a* . . . of the turbine moving blades 11, 12 . . . , can be reduced. As a result, the reliable turbine moving blades 11, 12 . . . can be realized.

(6) The primary contact face portion F is formed between each of the leading side snubbers 21*b*, 22*b* . . . and each of the trailing side snubbers 21*c*, 22*c* . . . , and the secondary contact face portion G is formed between each of the leading side snubbers 21*b*, 22*b* . . . and each of the airfoil tip portion 11*a*, 12*a* . . . , and accordingly, a contact area, for example, on the contact faces 22*f*, 21*f* in the primary contact face portion F can be sufficiently secured. Thus, the contact pressure imposed on the contact faces of the primary contact face portion F can be reduced.

(7) The secondary contact face portion G is formed by pressing the projecting portion end face (for example, the projecting portion end face 22*g*) of the leading side snubbers 21*b*, 22*b* . . . and the pressure side face near the trailing edge (for example, the pressure side face 21*ga* near the trailing edge) of the facing airfoil tip portion 11*a*, 12*a* . . . , in the assembled state of the turbine moving blades 11, 12 . . . .

Accordingly, the dispersion of the blade relative positions caused by the dispersion of the gap Df in the primary contact face portion F, which is actually indispensable at the assembly of the turbine moving blades 11, 12 . . . , can be corrected during the increasing of the rotor speed of the turbine by restoring behavior performed by the press force (contact reaction force Fc) of the secondary contact face portion G. As a result, the blade relative positions of almost as designed state can be realized at the rated rotor speed of the turbine.

It is to be noted that this advantageous effect (7) may also be achieved in the first embodiment likewise because the contact faces (for example, the contact face 11*g*, 12*g*) of the secondary contact face portion G are formed by being pressed during increasing the rotor speed of the turbine moving blades 11, 12 . . . .

(8) The adjacent blade proximal face portion H having the gap Dh is formed by the projecting portion end face 21*h* of the trailing side snubber 21*c*, which constitutes the primary contact face portion F, of the turbine moving blade 11 and the suction side face 22*h* near the leading edge of the airfoil tip 12*a* of the turbine moving blade 12 adjacent to the trailing edge side of the turbine moving blade 11. The adjacent blade proximal face portion H can prevent the erosion growth, which may be caused by the drain coming in from the direction of arrow W in FIG. 11 to the projecting portion root portions (for example, the projecting portion root portions 22*r*) of the leading side snubbers 21*b*, 22*b* . . . , by the shielding shape of the trailing side snubbers 21*c*, 22*c* . . . .

Furthermore, the gap Dh of the adjacent blade proximal face portion H at the time of assembling the turbine moving blades 11, 12 . . . is effective as an index for determining whether the assembled state of the turbine moving blades 11, 12 . . . is good or not likewise the gap Df of the primary contact face portion F and the gap Dg of the secondary contact face portion. Since the clearance of the gap Dg is smaller than that of the gap Dh, the gap Dg achieves the vibration suppression effect, and on the other hand, the gap Df achieves the vibration suppression effect in the axial direction.

Finally, it is further to be noted that the present invention is not limited to the embodiments described above and many other changes and modifications may be made without departing from the scopes of the appended claims.

This application claims priority from Japanese Patent Application 2008-235556, filed Sep. 12, 2008, which is incorporated herein by reference in its entirety.

What is claimed is:

1. A turbine moving blade assembly comprising:

a plurality of moving blades arranged in a circumferential direction of a rotor of a turbine;

an airfoil portion of each of moving blades twisted, in a sectional shape, from a root portion of the blade to a tip portion thereof;

a shroud formed integrally with the tip portion of the moving blade; and a coupling member disposed to front end portion of the moving blades including the tip portion of the moving blade and the shroud so as to connect all the moving blades in one group, wherein the coupling member has: a primary contact face portion, which has flat contact faces forming an acute angle from a rotating direction of the turbine toward an outlet side in an axial direction of the rotor of the turbine and facing the tip portions of the turbine moving blades adjacent to each other in the circumferential direction; a secondary contact face portion which has flat contact faces forming an obtuse angle from the rotating direction of the turbine toward the outlet side in the axial direction of the rotor and facing the tip portions of the turbine moving blades adjacent to each other in the circumferential direction, the respective primary contact face portions of the turbine moving blades are in a separated state during assembly of the blades, the respective secondary contact face portions of the turbine moving blades are in a contacting state during assembly of the blades, and as a rotor speed increases, the respective second contact face portions of the turbine moving blades shift from the contacting state to the separated state, and thereafter, as the rotor speed further increases, the primary contact face portions shift from the separated state to the contacting state of the turbine moving blades adjacent to each other in the circumferential direction.

2. The turbine moving blade assembly according to claim 1, wherein the primary contact face portion is disposed on the outlet side in the axial direction of the rotor of the turbine with respect to the secondary contact face portion.

3. The turbine moving blade assembly according to claim 1, wherein the primary contact face portion is disposed on the inlet side in the axial direction of the rotor with respect to the secondary contact face portion.

4. The turbine moving blade assembly according to claim 3, wherein the shroud in each turbine moving blade has a leading side snubber projecting from a suction side of the airfoil tip portion and a trailing side snubber projecting from a pressure side thereof, the primary contact face portion is formed to a leading edge side of the leading side snubber and to a trailing edge side of the trailing side snubber, and the secondary contact face portion is disposed on the outlet side in the axial direction of the rotor in the primary contact face portion disposed to the leading side snubber and to the pressure side in the trailing edge side of the airfoil tip portion.

5. The turbine moving blade assembly according to claim 3, wherein the shroud in each of the turbine moving blades has a leading side snubber projecting from a suction side of the airfoil tip portion and a trailing side snubber projecting from a pressure side thereof, and an adjacent blade proximal face portion facing, with a gap, the tip portions of the turbine moving blades adjacent to each other in the circumferential direction, is disposed on the inlet side of the primary contact face portion in the axial direction of the rotor of the turbine.

6. The turbine moving blade assembly according to claim 1, wherein the rotor speed at a contacting start, in which the primary contact face portion shifts to the contacting state, is set to 60% to 75% of a rated rotor speed, and the rotor speed at a separating start, in which the secondary contact face portion shifts from the contacting state to the separated state, is set lower than the contacting start rotor speed of the primary contact face portion by 5% to 20% of the rated rotor speed.

7. A turbine comprising:

a casing;

a turbine rotor rotatably accommodated in the casing; and a turbine moving blade assembly, according to claim 1, provided for the turbine rotor.

* * * * *